US011879250B2

(12) United States Patent
Harnish

(10) Patent No.: US 11,879,250 B2
(45) Date of Patent: Jan. 23, 2024

(54) PANEL ASSEMBLY FOR A SUSPENDED CEILING SYSTEM, CORNER BRACKET THEREOF, AND RELATED METHODS

(71) Applicant: ARMSTRONG WORLD INDUSTRIES, INC., Lancaster, PA (US)

(72) Inventor: Scott D. Harnish, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 15 days.

(21) Appl. No.: 17/549,032

(22) Filed: Dec. 13, 2021

(65) Prior Publication Data

US 2022/0186495 A1 Jun. 16, 2022

Related U.S. Application Data

(60) Provisional application No. 63/124,260, filed on Dec. 11, 2020.

(51) Int. Cl.
*E04B 9/22* (2006.01)
*E04B 9/04* (2006.01)

(52) U.S. Cl.
CPC ..... *E04B 9/225* (2013.01); *E04B 9/04* (2013.01)

(58) Field of Classification Search
None
See application file for complete search history.

(56) References Cited

U.S. PATENT DOCUMENTS 2,882,558 A 4/1959 Jacobson
3,035,672 A * 5/1962 Tuten ..... E04B 9/32 52/506.07
3,874,132 A * 4/1975 Mendelow ..... E04H 4/0018 52/71
4,438,613 A 3/1984 Hintsa
4,548,010 A 10/1985 Hintsa
4,744,188 A 5/1988 Ahren
(Continued)

FOREIGN PATENT DOCUMENTS

DE 1170600 B 5/1964
DE 3837296 A1 * 9/1990
(Continued)

OTHER PUBLICATIONS

International Search Report for Co-Pending Application No. PCT/US2021/063065 dated Apr. 21, 2022.

*Primary Examiner* — Joshua K Ihezie
(74) *Attorney, Agent, or Firm* — Patrick Sheldrake

(57) ABSTRACT

A panel assembly for a suspended ceiling system, an adjustable corner bracket thereof, and a method of assembling such a panel assembly. The panel assembly may include a ceiling panel having a groove in its rear surface, a plurality of suspension bars disposed within the groove along the sides thereof, and a plurality of corner brackets disposed within the groove along the corners thereof. The corner brackets may include a first arm portion extending along a first arm axis and a second arm portion extending along a second arm axis. The corner brackets may be adjustable to alter an angle measured between the first and second arm axes so that the corner brackets may be used in different grooves having different shapes.

17 Claims, 19 Drawing Sheets

(56) References Cited

U.S. PATENT DOCUMENTS

| | | | | |
|---|---|---|---|---|
| 4,890,950 | A * | 1/1990 | Yoo | F16C 11/10 182/163 |
| 5,241,799 | A | 9/1993 | Jahn | |
| 5,279,090 | A * | 1/1994 | Yamaguchi | E04B 9/14 55/355 |
| 5,349,800 | A * | 9/1994 | Peng | E04B 9/18 403/174 |
| 5,620,272 | A * | 4/1997 | Sheng | E06C 1/32 403/92 |
| 5,937,605 | A * | 8/1999 | Wendt | E04B 9/30 52/506.07 |
| 6,318,042 | B1 | 11/2001 | Bloom | |
| 6,729,096 | B1 | 5/2004 | Ashmore | |
| 6,834,467 | B2 | 12/2004 | Gulbrandsen | |
| 7,770,349 | B2 | 8/2010 | Tedesco | |
| 8,046,966 | B2 | 11/2011 | Moore | |
| 8,215,075 | B2 * | 7/2012 | Bergman | E04B 9/245 52/506.07 |
| 8,443,564 | B2 | 5/2013 | Bankston, Jr. | |
| 8,596,008 | B2 * | 12/2013 | Waters | E04B 9/04 52/39 |
| 8,813,457 | B2 | 8/2014 | Underkofler | |
| 9,988,820 | B2 * | 6/2018 | Komatsu | E04B 9/24 |
| 10,194,762 | B2 * | 2/2019 | Isaacs | E06B 3/9644 |
| 10,724,237 | B2 | 7/2020 | Waters | |
| 11,280,089 | B2 * | 3/2022 | Harnish | E04B 9/14 |
| 2004/0065037 | A1 | 4/2004 | See | |
| 2007/0228236 | A1 * | 10/2007 | MacKay | A47B 57/06 248/205.3 |
| 2008/0060306 | A1 | 3/2008 | Platt | |
| 2010/0238544 | A1 * | 9/2010 | Elliott | G03B 21/62 359/443 |
| 2015/0159375 | A1 * | 6/2015 | Waters | E04B 9/04 52/506.07 |
| 2015/0211231 | A1 | 7/2015 | Bergman | |
| 2015/0233116 | A1 | 8/2015 | Mayer | |

FOREIGN PATENT DOCUMENTS

| | | | |
|---|---|---|---|
| EP | 0421255 | A2 | 4/1991 |
| JP | 2000-297469 | A | 10/2000 |
| JP | 2008-075282 | A | 4/2008 |
| KR | 10-1302713 | B1 | 9/2013 |
| WO | WO 2007/012077 | A2 | 3/2007 |

* cited by examiner

PANEL ASSEMBLY FOR A SUSPENDED CEILING SYSTEM, CORNER BRACKET THEREOF, AND RELATED METHODS

BACKGROUND

Suspended ceilings are used in interior spaces for several reasons. First, suspended ceilings may hide mechanical devices such as heating and cooling systems from view. Second, suspended ceilings may include acoustical panels to improve the sound quality within the interior space. Third, suspended ceilings may create a desirable aesthetic. Some types of suspended ceiling systems are formed by hanging ceiling panels from a gridwork formed from structural support members with the ceiling panels spaced a distance below the gridwork. In order to achieve this type of a setup, hooks may be attached to the ceiling panels for purposes of hanging the ceiling panels from the gridwork. To attach the hooks to the ceiling panels, additional mechanical components such as brackets and suspension members may be required. Different arrangements of ceiling panels may require different brackets with different shapes and angles to achieve a desired aesthetic. This requires maintaining several different components in inventory and fronting the costs for tooling of multiple different components. Thus, a need exists for an improvement whereby a single component can be used regardless of the configuration of the ceiling panels within the system.

SUMMARY

The present invention is directed to a panel assembly for a suspended ceiling system, an adjustable corner bracket thereof, and a method of assembling such a panel assembly. The panel assembly may include a ceiling panel having a groove in its rear surface, a plurality of suspension bars disposed within the groove along the sides thereof, and a plurality of corner brackets disposed within the groove along the corners thereof. The corner brackets may include a first arm portion extending along a first arm axis and a second arm portion extending along a second arm axis. The corner brackets may be adjustable to alter an angle measured between the first and second arm axes so that the corner brackets may be used in different grooves having different shapes.

In one aspect, the invention may be a panel assembly for a suspended ceiling system, the panel assembly comprising: a ceiling panel comprising a front surface, a rear surface opposite the front surface, and a groove formed into the rear surface, the groove comprising a plurality of sides and a plurality of corners; a plurality of suspension bars disposed within the groove of the ceiling panel along the sides thereof, each of the suspension bars defining a channel; a plurality of corner brackets disposed within the groove of the ceiling panel along the corners thereof, each of the corner brackets comprising a first arm portion extending along a first arm axis and at least partially nesting within the channel of a first one of the suspension bars and a second arm portion extending along a second arm axis and at least partially nesting within the channel of a second one of the suspension bars; and wherein the corner brackets are adjustable to alter an angle measured between the first and second arm axes.

In another aspect, the invention may be a method of assembling a panel assembly of a suspended ceiling system, the method comprising: adjusting a plurality of corner brackets so that an angle measured between a first arm axis of a first arm portion and a second arm axis of a second arm portion of each of the corner brackets matches an interior angle of a polygon-shaped groove formed into a rear surface of a ceiling panel; and inserting the plurality of corner brackets and a plurality of suspension bars into the polygon-shaped groove in the rear surface of the ceiling panel, wherein the corner brackets are positioned along corners of the polygon-shaped groove and the suspension bars are positioned along sides of the polygon-shaped groove.

In yet another aspect, the invention may be an adjustable corner bracket for a panel assembly of a suspended ceiling system, the adjustable corner bracket configured to be disposed within a groove on a rear surface of a ceiling panel of the panel assembly, the adjustable corner bracket comprising: a first arm component comprising a first arm portion that extends along a first arm axis, the first arm component comprising a first aperture; a second arm component comprising a second arm portion that extends along a second arm axis, the second arm component comprising a second aperture that is surrounded by an annular wall that nests within the first aperture of the first arm component to couple the second arm component to the first arm component; and wherein the first and second arm components are rotatable relative to one another about a rotational axis that intersects the first and second apertures to adjust an angle measured between the first and second arm axes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments of the present invention will be described with reference to the following drawings, where like elements are labeled similarly, and in which.

Figure 1:
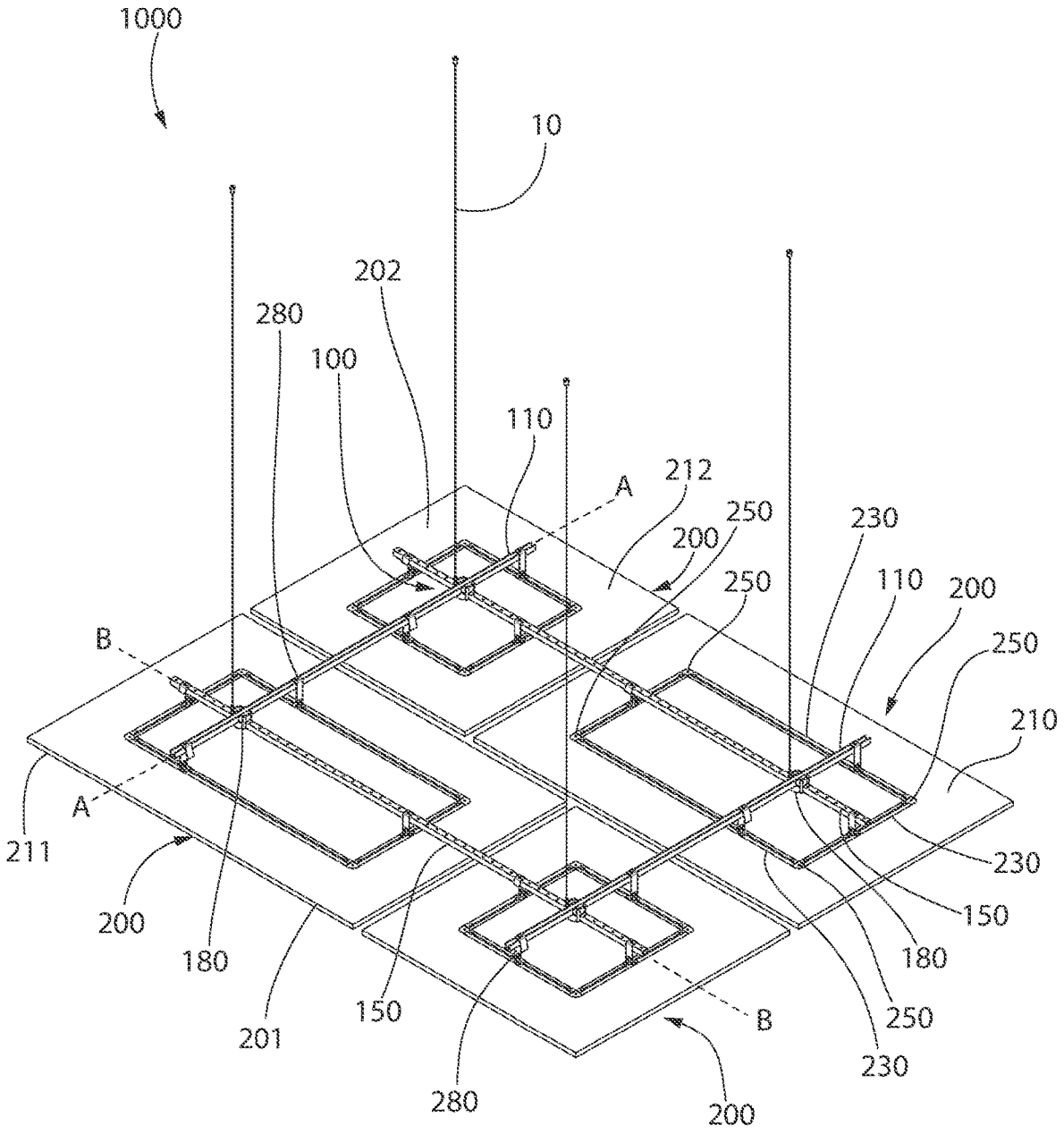
FIG. 1 is perspective view of a suspended ceiling system in accordance with an embodiment of the present invention.

All drawings are schematic and not necessarily to scale. Parts given a reference numerical designation in one figure may be considered to be the same parts where they appear in other figures without a reference numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Referring first to FIG. 1, a suspended ceiling system 1000 is illustrated in accordance with an embodiment of the present invention. The suspended ceiling system 1000 generally comprises an overhead grid assembly 100 and a plurality of panel assemblies 200 which are coupled to or otherwise made to hang from the overhead grid assembly 100. The overhead grid assembly 100 hangs from a structural framework such as any of various beams, joists, or the like which form a part of the building within which the suspended ceiling system 1000 is being hung. In particular, the overhead grid assembly 100 hangs from the structural framework by one or more cables or hanger wires 10 which are attached to the overhead grid assembly 100 and to the structural framework of the building. The structural framework is not illustrated in the provided figures, but its underlying structure and purpose is conventional and readily understood by those of ordinary skill in the art.

Figure 6:
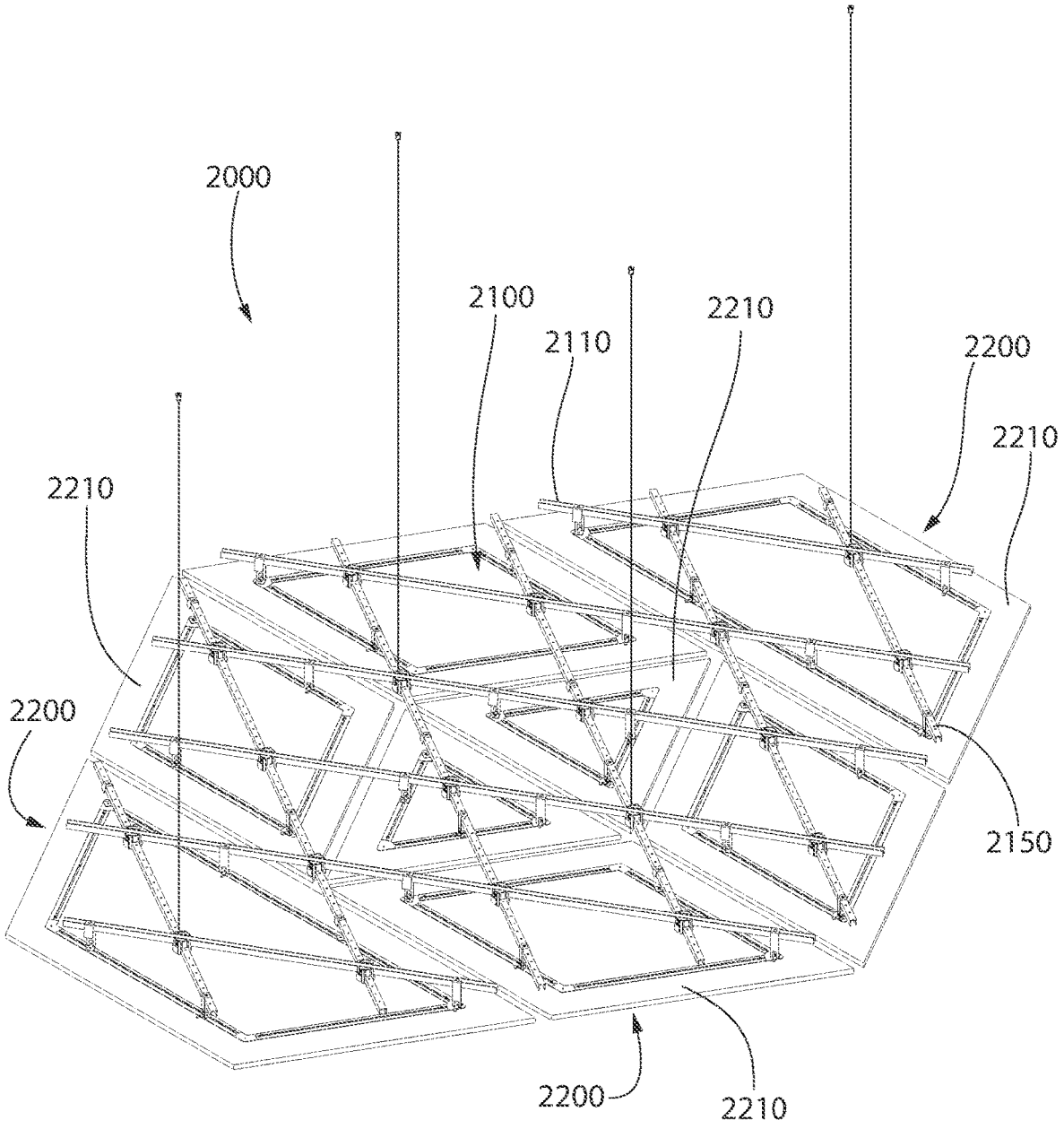
FIG. 6 is a perspective view of a suspended ceiling system in accordance with another embodiment of the present invention.

The overhead grid assembly 100 comprises support members (also known as beams, which may include main beams and cross-tee beams) which are arranged in an intersecting grid-like pattern. However, the exact arrangement of the support members of the overhead grid assembly 100 may be modified in some embodiments in order to create a desired aesthetic with the panel assemblies 200. Again, a comparison of FIG. 1 and FIG. 6 illustrates two different arrangements or intersection angles for the various support members.

Still referring to FIG. 1, the overhead grid assembly 100 comprises a plurality of first support members 110 and a plurality of second support members 150. Although only two of the first support members 110 and two of the second support members 150 are illustrated in FIG. 1, the overhead grid assembly 100 may include as many as are needed to fill the space from which the panel assemblies 200 are to be hung. Each of the plurality of first support members 110 comprises a first longitudinal axis A-A. Furthermore, the first support members 110 are arranged so that the first longitudinal axes A-A of each of the plurality of first support members 110 are oriented parallel to one another (i.e., the plurality of first support members 110 are arranged in a parallel configuration). Each of the plurality of second support members 150 comprises a second longitudinal axis B-B. Furthermore, the second support members 150 are arranged so that the second longitudinal axes B-B of each of the plurality of second support members 150 are oriented parallel to one another (i.e., the plurality of second support members 150 are arranged in a parallel configuration).

In the exemplified embodiment, each of the plurality of first support members 110 is oriented perpendicular relative to each of the plurality of second support members 150. That is, the overhead grid assembly 100 is configured so that the plurality of first support members 110 are parallel to each other and perpendicular to the plurality of second support members 150, which are also oriented parallel to one another. Thus, the plurality of first and second support members 110, 150 define a plurality of square or rectangular shaped openings with the area of intersection between the first and second support members 110, 150 forming a corner of each of the openings.

Figure 2:
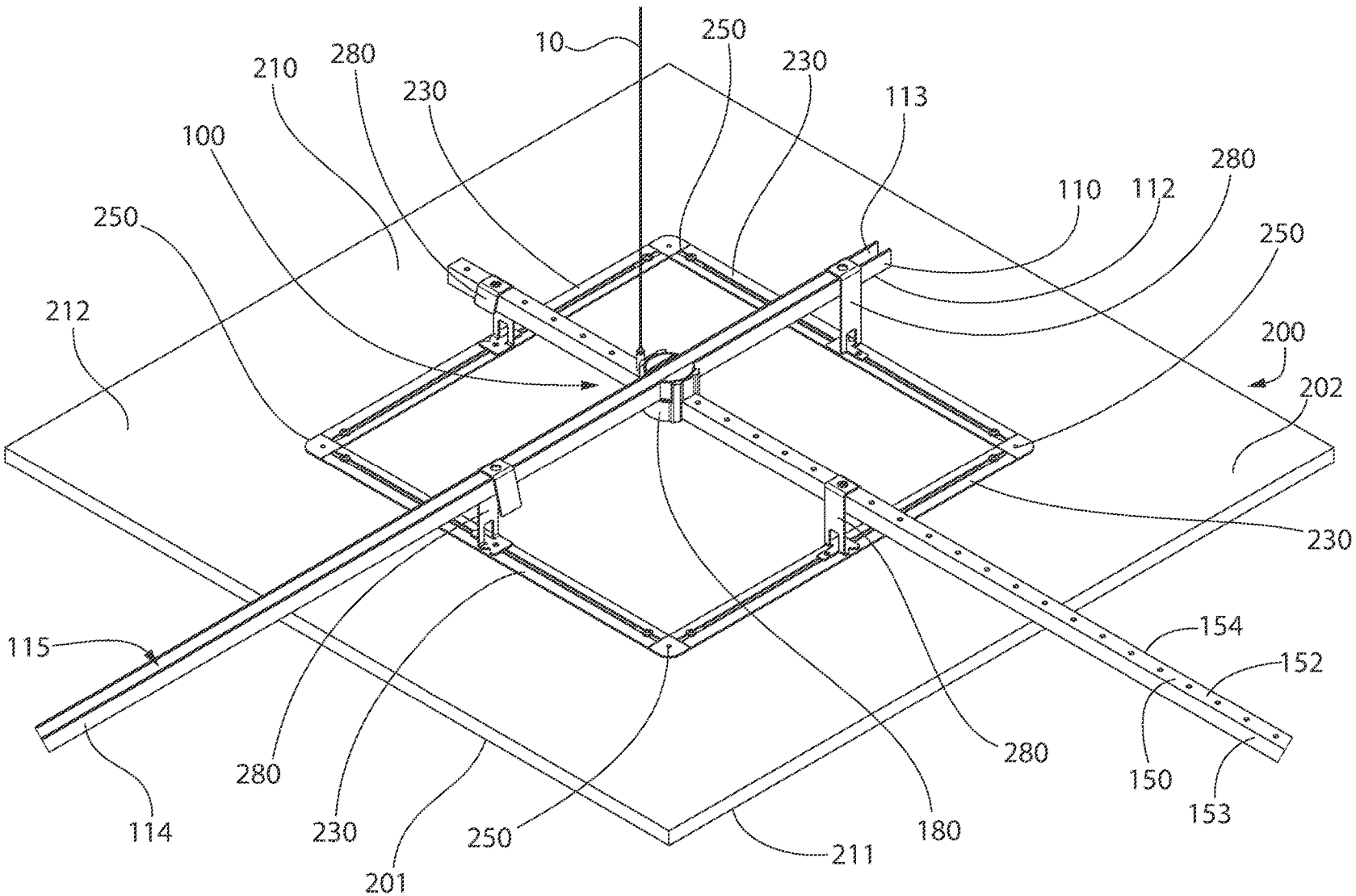
FIG. 2 is a perspective view of a portion of the suspended ceiling system of FIG. 1.

Referring to FIGS. 1 and 2, each of the plurality of second support members 150 is attached to the structural framework via the one or more hangers 10. Moreover, the plurality of first support members 110 rest atop of the second support members 150 in the intersecting arrangement noted above. In the exemplified embodiment, the plurality of first support members 110 are not directly affixed to the structural framework via the hangers 10. Rather, in the exemplified embodiment only the second support members 150 are attached to the structural framework via the hangers 10, and the first support members 110 stay in place by being positioned atop of the second support members 150 and by coupling the second support members 150 to the first support members 110. In particular, the first and second support members 110, 150 comprise holes that are aligned so that a fastener can extend through the holes to couple the first support members 110 to the second support members 150. In the exemplified embodiment the first support members 110 and the second support members 150 are structurally identical. Of course, this need not be the case in all embodiments and the first and second support members 110, 150 may have some structural differences while still enabling them to form the overhead grid assembly 100 and support the panel assemblies 200 as described herein.

As noted above, in the exemplified embodiment the first support members 110 and the second support members 150 are structurally identical. In particular, the first and second support members 110, 150 are U-shaped members. That is, the first support members 110 comprise a floor 112 and first and second sidewalls 113, 114 extending from the floor 112. The floor 112 and the first and second sidewalls 113, 114 collectively define an upward facing cavity 115. The second support members 150 comprise a floor 152 and first and second sidewalls 153, 154 extending from the floor 152. The floor 152 and the first and second sidewalls 153, 154 collectively define a downward facing cavity (not visible in the views provided). That is, the cavity 115 of the first support members 110 face upwardly towards the structural framework and the cavity of the second support members 150 face downwardly towards the floor of the room within which the overhead grid assembly 100 is positioned. In the exemplified embodiment, the first and second support members 110, 150 are arranged so that the outer surface of the floor 112 of the first support members 110 rest atop of the outer surface of the floor 152 of the second support members 150. Thus, the floors of the first and second support members 110, 150 face each other and the first and second sidewalls 113, 114 of the first support members 110 extend in an opposite direction than the first and second sidewalls 153, 154 of the second support members 150.

Because the first support members 110 rest atop of the second support members 150, the first and second support members 110, 150 do not intersect in a traditional sense. That is, the first support members 110 are located on a first plane and the second support members 150 are located on a second plane that is at a different elevation within the space than the first plane. The first and second planes are parallel to one another and are oriented horizontally but at different heights or elevations within the space or room. Thus, the first and second support members 110, 150 and hence also the first and second longitudinal axes A-A, B-B lie in different planes that are parallel to one another. Thus, as used herein, the term "intersect" includes two structures or axes that cross over each other even though they may be located at different elevations. Stated another way, the first and second support members 110, 150 in FIGS. 1 and 2 are oriented perpendicularly relative to each other despite the fact that they are positioned on different planes and therefore do not intersect in the traditional sense.

Figure 4A:
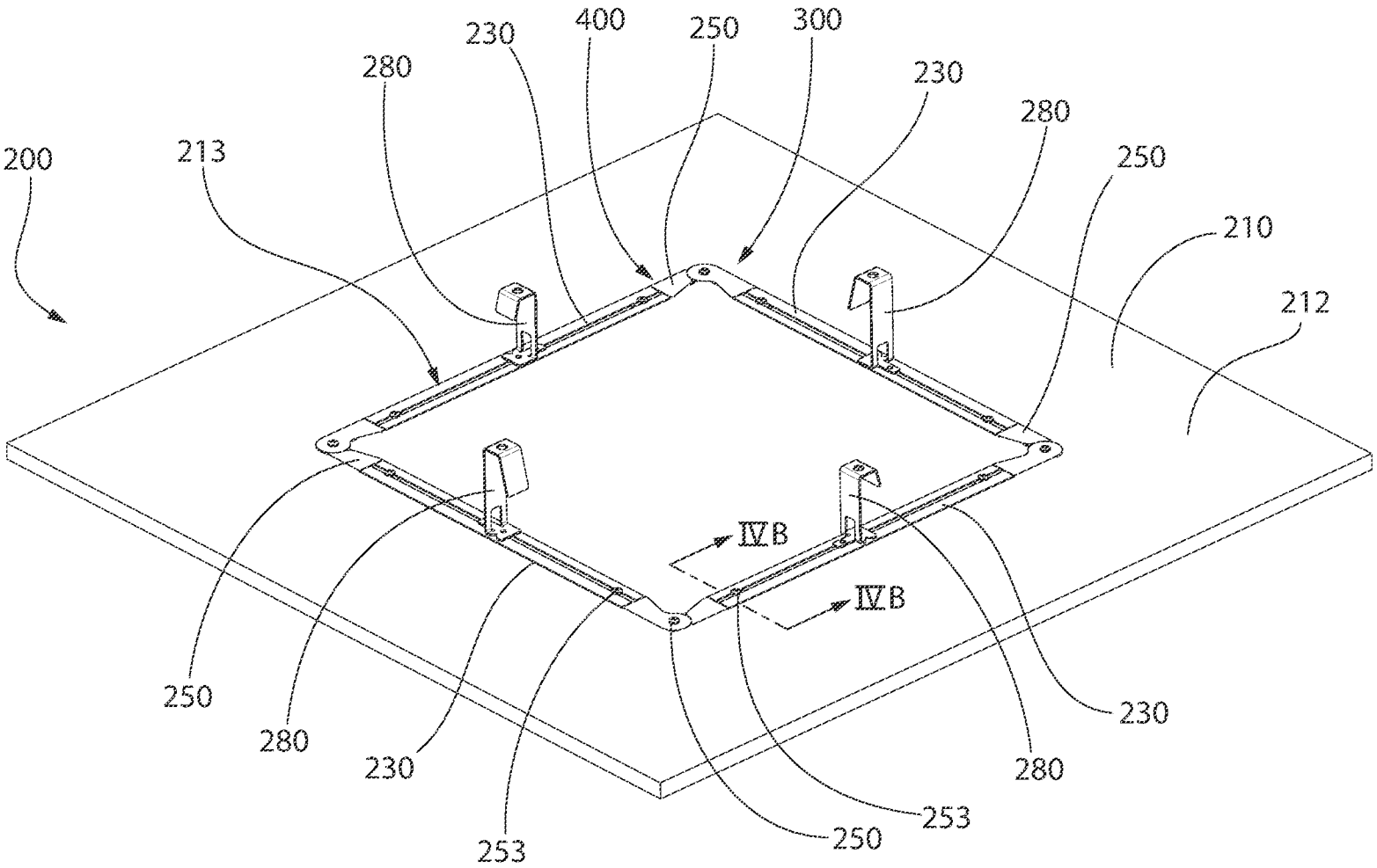
FIG. 4A is an assembled perspective view of the panel assembly of FIG. 3.

In addition to the first and second support members 110, 150 being coupled together with a fastener that extends through the openings, the overhead grid assembly 100 also comprises bracket member 180 that is configured to maintain the first and second support members 110, 150 in a particular arrangement and at a particular relative angle. Specifically, the bracket member 180 comprises a first channel that receives a portion of the first support members 110 and a second channel that receives a portion of the second support members 150. Thus, the bracket member 180 helps to maintain the first and second support members 110, 150 in the perpendicular arrangement shown in FIGS. 1 and 2. The bracket members 180 may also help to maintain the first and second support members 110, 150 at a different relative orientation or angle, such as that which is shown in FIGS. 4 and 5.

In the exemplified embodiment, the panel assemblies 200 comprise a ceiling panel 210 and a suspension kit which includes a plurality of suspension bars 230, a plurality of corner brackets 250, and a plurality of hook members 280. The ceiling panel 210 may be any type of panel that has been used for ceiling systems including fibrous panels made from mineral wool, perlite, cellulosic fibers, fillers, binders, and the like. Of course, the ceiling panel 210 may be formed from other materials as well, including plastics, thermoplastics, wood, metal, fiberglass, gypsum, clay, starch, glass, or the like. The invention is not to be particularly limited by the material used to form the ceiling panels 210 in all embodiments. The ceiling panel 210 may be an acoustic panel in that they may comprise acoustic properties to improve the sound quality in the space within which the suspended ceiling system 1000 is being used. The panel assemblies 200 may be hung in a desired pattern to create a desired aesthetic. For example, in FIG. 1 the panel assemblies 200 include square and rectangular ceiling panels 210 that are collectively arranged in a rectangle. However, the ceiling panels 210 may have other shapes in other embodiments and they may be arranged in different overall shapes. This can be seen with a comparison of FIGS. 1 and 6. Additional details of the ceiling panels 200 and its components will be provided below with reference to FIGS. 4-5B.

Figure 3:
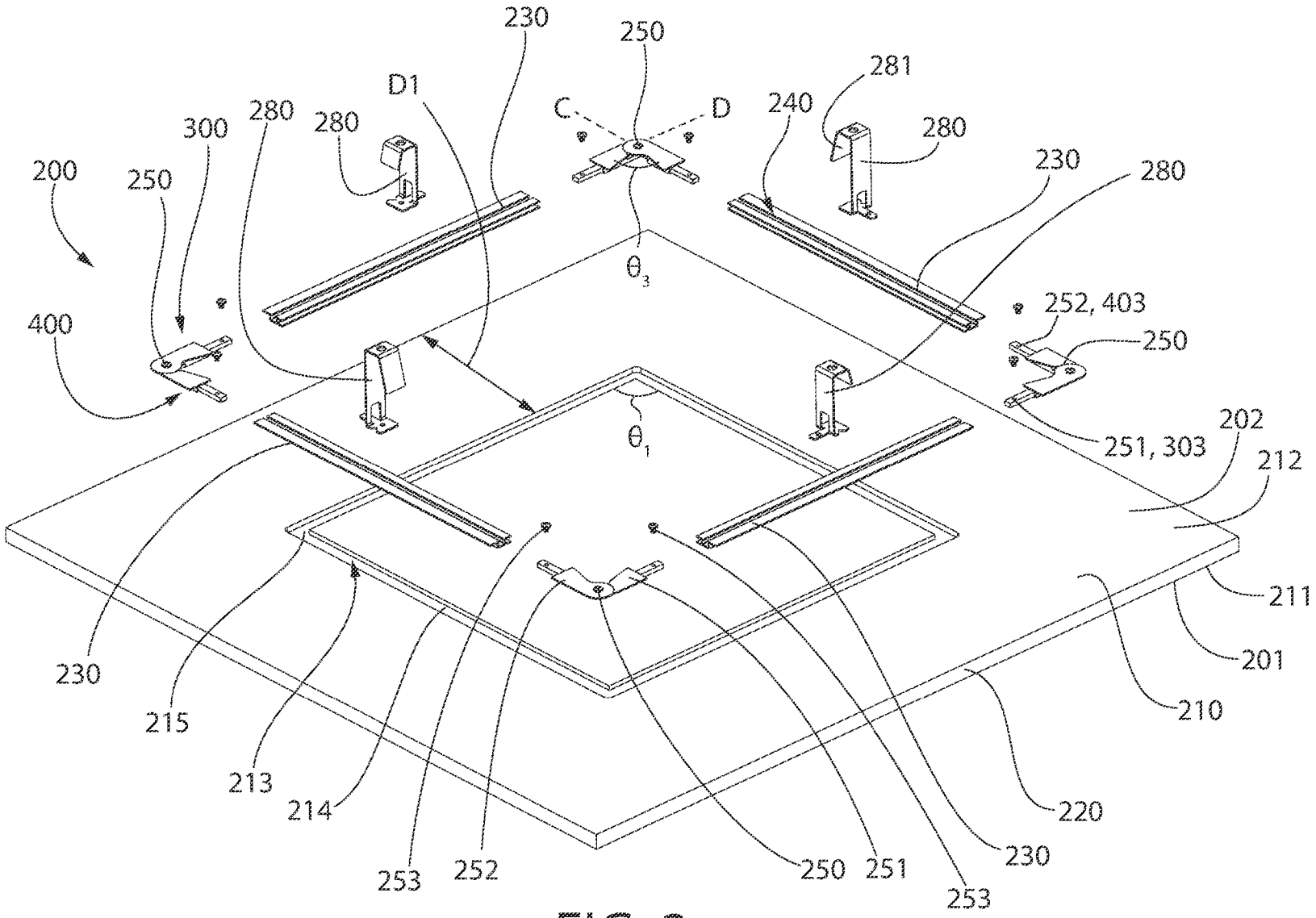
FIG. 3 is an exploded perspective view of a panel assembly of the suspended ceiling system of FIG. 1.
Figure 4B:
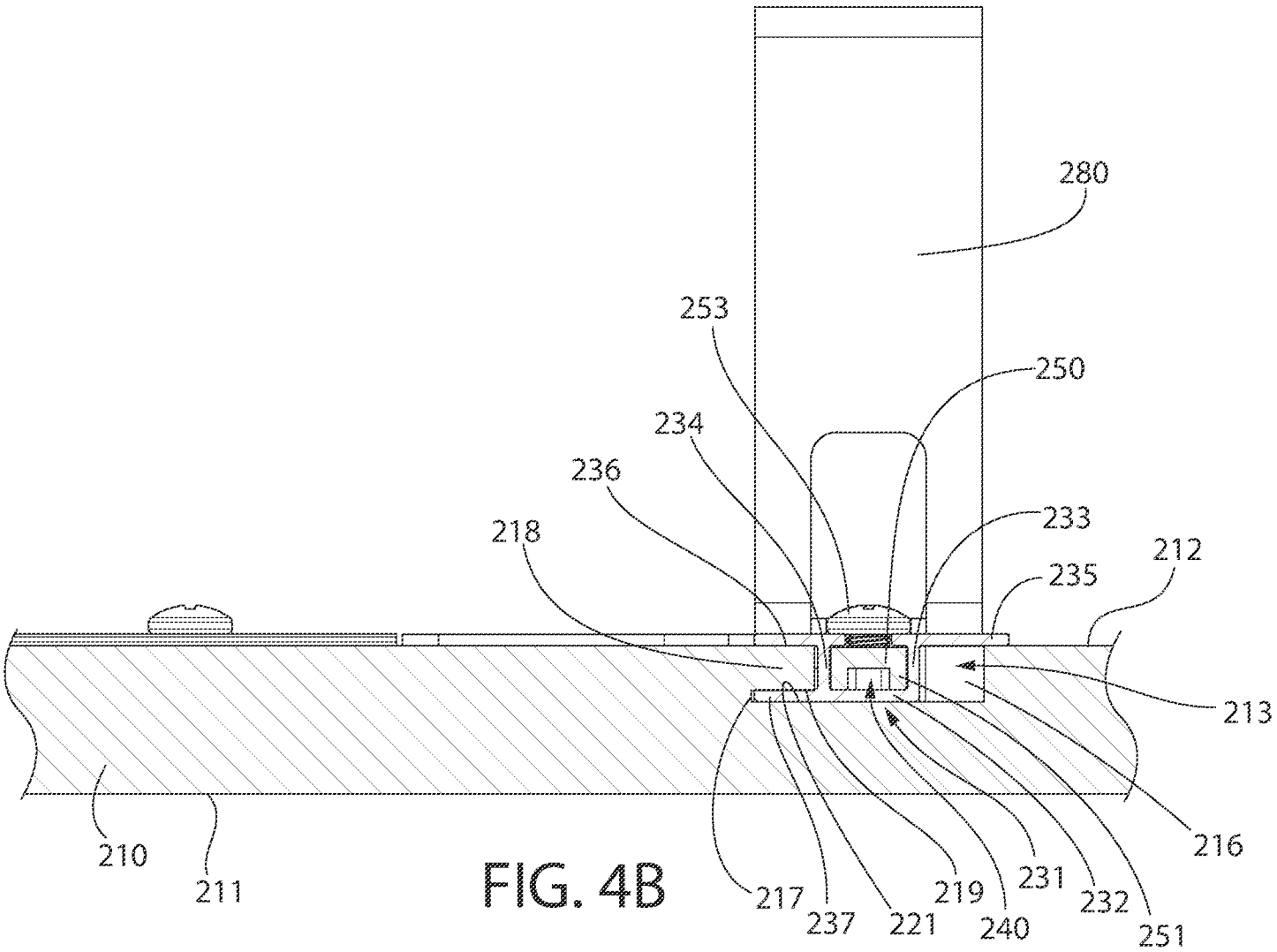
FIG. 4B is a cross-sectional view taken along line IVB-IVB of FIG. 4A.
Figure 5:
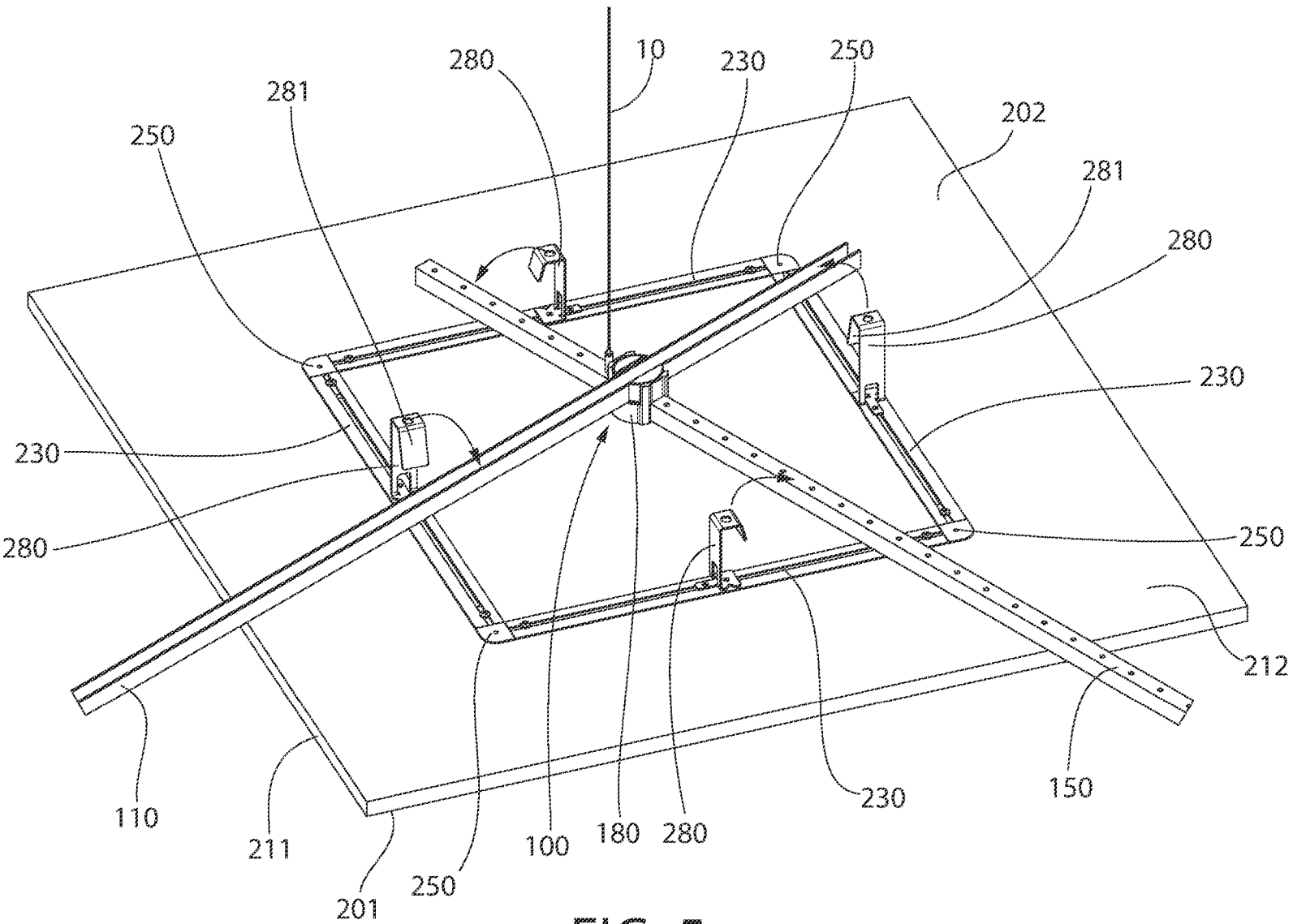
FIG. 5 is a perspective view of the portion of the suspended ceiling system of FIG. 2, illustrating the process by which a panel assembly thereof is coupled to an overhead grid assembly thereof.

Referring to FIGS. 3-4B, the panel assemblies 200 will be described in greater detail. The ceiling panels 210 comprise a front surface 211 (which forms a front surface 201 of the panel assembly 200) which is exposed to the interior space or room and a rear surface 212 (which forms a rear surface 202 of the panel assemblies 200 opposite the front surface 211). In the exemplified embodiment, the front and rear surfaces 211, 212 of the ceiling panels 210 are planar and flat, although this is not required in all embodiments and the front and rear surfaces 211, 212 of the ceiling panels 210 could be wavy, undulated, contoured, or the like in various other embodiments. The rear surfaces 212 of the ceiling panels 210 face the overhead grid assembly 100 when the ceiling panels 20 are installed thereon. The front surfaces 211 of the ceiling panels 210 are not fully visible in the provided views, but the front surfaces 211 are the surfaces which are visible to a user standing in the room within which the suspended ceiling system 1000 is positioned.

In the exemplified embodiment, a groove 213 is formed into the rear surface 212 of the ceiling panels 210. The groove 213 forms a channel or recess within the rear surface 212 of the ceiling panels 210. In the exemplified embodiment, the groove 213 is in the shape of a square, which matches the shape of the ceiling panel 210 which is also square. Thus, in some embodiments the shape of the groove 213 may match the shape of the ceiling panel 210 within which the groove 213 is formed (e.g., a rectangular ceiling panel may have a rectangular groove, a triangular ceiling panel may have a triangular groove, etc.). However, this is not required in all embodiments and the groove 213 may take on a shape that differs from the shape of the ceiling panel 210 in some embodiments (e.g., a square ceiling panel may have a triangular shaped groove, a hexagonal ceiling panel may have a square shaped groove, etc.).

In the exemplified embodiment, the groove 213 is in the shape of a closed polygon. The invention is not to be so limited and the groove 213 may include curved portions in addition to linear portions in some embodiments. However, a polygonal shape is typically used for the grooves 213 as it renders the panel assemblies 200 better able to be coupled to the overhead grid assembly 100 as described herein. Thus, in the exemplified embodiment the groove 213 comprises a plurality of sides 214 and a plurality of corners 215. Each pair of adjacent sides 214 intersects at one of the corners 215. Furthermore, the adjacent sides 214 intersect to form an interior angle Θ1 at each of the corners 215. In the exemplified embodiment, the groove 213 is square and so each of the interior angles Θ1 is the same (e.g.,) 90°. However, this is not required in all embodiments and the groove 213 could have different interior angles Θ1 at its different corners in other embodiments, depending on the shape of the groove 213. For example without limitation, the groove could be in the shape of a right triangle, whereby one of the interior angles is 90° and the other two interior angles may be 45°.

In the exemplified embodiment, the groove 213 is a continuous groove that forms a polygon shape without interruption. However, the invention is not to be so limited in all embodiments and the groove may be a discontinuous groove formed by groove segments that are spaced apart in some embodiments. Variations such as this which do not affect the functionality of the system may fall within the scope of the invention claimed herein.

The ceiling panel 210 comprises a peripheral edge 220 that extends between the front and rear surfaces 211, 212. Furthermore, the groove 213 is spaced inwardly of the peripheral edge 220. In particular, each of the sides 214 of the groove 213 is spaced a distance D1 from the peripheral edge 220 of the ceiling panel 210. In the exemplified embodiment, each of the sides 214 of the groove 213 is spaced the same distance from the peripheral edge 220 of the ceiling panel 210, although this is not required in all embodiments and different sides 214 of the groove 213 could be spaced at different linear distances from the peripheral edge 220 of the ceiling panel 210 in other embodiments.

Referring briefly to FIG. 4B, the groove 213 comprises a main portion 216 and an undercut portion 217 that extends from the main portion 216 in a direction moving away from the peripheral edge 220. In an alternative embodiment, the undercut portion 217 could extend from the main portion 216 in a direction that is towards the peripheral edge 220 with the same function being achieved. The undercut portion 217 of the groove 213 is positioned beneath a lip 218 of the ceiling panel 210 which is cantilevered over the undercut portion 217. That is, a lower surface 219 of the lip 218 is spaced apart from a floor 221 of the groove 213 by a gap (with the gap forming the undercut portion 217 of the groove 213). The purpose of the groove 213 and the undercut portion 217 thereof is to facilitate the coupling of the suspension bars 230 to the ceiling panel 210, as described in greater detail below.

Referring again to FIGS. 3-4B concurrently, as noted above the panel assembly 200 comprises the plurality of suspension bars 230, which are configured to be disposed within the groove 213 of the ceiling panels 210 and coupled thereto. The suspension bars 230 comprise (features labeled in FIG. 4B for easy of clarity and understanding) a U-shaped body portion 231 comprising a floor portion 232, a first sidewall 233 extending from the floor portion 232 to a distal end, and a second sidewall 234 extending from the floor portion 232 to a distal end. The first and second sidewalls 233, 234 are spaced apart from one another to define a channel 240 of the suspension bars 230. Furthermore, the suspension bars 230 comprise a first flange 235 extending horizontally (perpendicular) from the first sidewall 233 and a second flange 236 extending horizontally (perpendicular) from the second sidewall 234. Finally, the suspension bars 230 comprise a projecting flange portion 237 that extends from the second sidewall 234 along a bottom end of the second sidewall 234. That is, the projecting flange 237 is coplanar with the floor 232 of the suspension bar 230 in the exemplified embodiment, although the position of the projecting flange portion 237 could be modified in other embodiments.

Each of the suspension bars 230 is disposed within the groove 213 on the rear surface 212 of the ceiling panel 210 along one of the sides 214 of the groove 213. Moreover, each of the suspension bars 230 has a length that is less than the length of the corresponding side 214 of the groove 213 within which it is positioned, so that there is space remaining for positioning the corner brackets 250 into the groove 213 as described below. The suspension bars 230 are disposed within the groove 213 so that the outer surface of the floor 232 of the suspension bars 230 are adjacent to or in contact with the floor 221 of the groove 213. Thus, the cavity 240 of the suspension bars 230 faces upwardly. Furthermore, the projecting flange portion 237 of the suspension bars 230 nest within the undercut portion 217 of the groove 213 to retain the suspension bars 230 in the groove 213 and maintain a coupling between the suspension bars 230 and the ceiling panel 210. Furthermore, the first and second flanges 235, 236 extend over top of the rear surface 212 of the ceiling panel 210. Thus, when the suspension bars 230 are installed as shown in FIGS. 4A and 4B, the lip 218 of the ceiling panel 210 is sandwiched between the projecting flange portion 237 and the second flange 236 of the suspension bar 230. The suspension bar 230 cannot be detached or decoupled from the ceiling panel 210 without first sliding the suspension bar 230 away from the undercut portion 217 of the groove 213, and this ensures that the suspension bar 230 remains disposed in the groove 213 unless and until a user purposely removes the suspension bar 230 from the groove 213.

In the exemplified embodiment, there are four distinct suspension bars 230 positioned in the groove 213 of the ceiling panel 210. This is because the groove 213 is square shaped and has four sides, so one of the suspension bars 230 is positioned along each of the sides. More or fewer suspension bars 230 may be used in other embodiments.. The suspension bars 230 may be configured to allow additional accessory items, such as the hook members 280 to be attached thereto. In particular, in the exemplified embodiment there are shown four hook members 280 such that one of the hook members 280 is attached to each of the suspension bars 230. In particular, the suspension bars 230 may include bolts fixed within the channel 240 at specific locations where it may be desired to attach the hook members 280. The hook members 280 may then be aligned with the bolts and secured thereto with fasteners such as screws. The hook members 280 include hook portions 281 that are configured to engage the support members 110, 150 of the overhead grid assembly 100 as discussed below with reference to FIG. 5. There may be bolts at different positions within the channels 240 of the suspension members 230 so that the hooks 280 can be coupled thereto at different positions, so the user/installer can select the location at which to attach the hooks 280 depending on the pattern of the panel assemblies 200 once they are suspended from the overhead grid assembly 100.

Finally, the panel assemblies 200 comprise the corner brackets 250, which further facilitate the retention of the suspension bars 230 within the grooves 213 of the ceiling panels 210. Previous to the invention disclosed herein, multiple different corner brackets 250 having different configurations were needed to be used with the different ceiling panels 210 having different shaped grooves 213. Specifically, the corner brackets 250 are disposed within the grooves 213 along the corners 215 of the grooves 213. The corner brackets 250 have two arm portions that extend, respectively, into the two sides 214 of the grooves 213 which intersect at a given corner. As a result, the two arm portions must intersect one another at an angle which matches the interior angle Θ1 of the groove 213 at that particular corner. Previous to the present invention, separately manufactured corner brackets 250 were necessary to achieve this. In the present invention, the corner brackets 250 are adjustable so that the angle between the two arm portions can be adjusted or altered to match any given interior angle of a particular groove within which the corner bracket 250 is to be positioned. The corner brackets 250 will be described in greater detail below with reference to FIGS. 8-12F.

The corner brackets 250 are installed in the ceiling panel 210 within the grooves 213 thereof along the corners 215 of the grooves 213. In the exemplified embodiment the groove 213 is square shaped and there are four of the corner brackets 250, one positioned along each corner 215 of the groove 213. When the corner brackets 250 are so installed, a portion of a first arm portion 251 of the corner brackets 250 nests within the channel 240 of one of the suspension bars 230 and a portion of a second arm portion 252 of the corner brackets 250 nests within the channel 240 of another one of the suspension bars 230. Each of the first and second arm portions 251, 252 of the corner bracket 250 may then be coupled to the suspension bar 230 with a fastener 253.

Referring to FIG. 5, the manner of attaching the panel assemblies 200 to the overhead grid assembly 100 will be briefly described. The panel assemblies 200 are attached to the overhead grid assembly 100 by aligning the hook portions 281 of the hook members 280 with one of each of the first and second support members 110, 150 and then rotating the panel assembly 200 until the hook portions 281 engage the first and second support members 110, 150. In particular, the panel assemblies 200 are positioned so that a centerpoint of the ceiling panel 210 is aligned with the node/intersection of the first and second support members 110, 150 (i.e., with the bracket member 180) and the panel assemblies 200 are raised so that the hook portions 281 are above the top ends of the first and second support members 110, 150. The panel assemblies 200 are then rotated so that the hook portions 281 of the hook members 280 are aligned with the first and second support members 110, 150. Finally, the panel assemblies 200 are dropped down so that the hook portions 281 rest atop of the support members 110, 150. As noted above, the first support members 110 are held at a higher elevation than the second support members 150. Thus, the hook members 280 may have different heights depending on whether they are configured to engage one of the first support members 110 or one of the second support members 150. That is, the hook members 280 that are intended to engage the first support members 110 may be taller than those that are intended to engage the second support members 150. Once all of the hook members 280 of a given panel assembly 200 are engaged with one of the first support members 110 or one of the second support members 150, the panel assembly 200 is sufficiently supported by the overhead grid assembly 100 as shown in FIGS. 1 and 2.

Before discussing the corner brackets 250 in detail, a second embodiment of a suspended ceiling system 2000 will be briefly described with reference to FIGS. 6, 7A, and 7B.. In particular, FIG. 6 illustrates a suspended ceiling system 2000 in accordance with another embodiment of the present invention. The suspended ceiling system 2000 is very similar to the suspended ceiling system 1000, and thus only the features of the suspended ceiling system 2000 which differ from the suspended ceiling system 1000 will be described below. It should be apparent that the description of the suspended ceiling system 1000 provided above is applicable to all other features and concepts of the suspended ceiling system 2000 as readily understood by viewing the drawings.

The suspended ceiling system 2000 comprises an overhead grid assembly 2100 and a plurality of panel assemblies 2200. The overhead grid assembly 2100 comprises a plurality of first support members 2110 that are arranged in a parallel configuration and a plurality of second support members 2150 that are arranged in a parallel configuration. However, in this embodiment the plurality of first support members 2110 are not oriented perpendicular to the plurality of second support members 2150. Rather, the plurality of first support members 2110 are oriented at an oblique angle relative to the plurality of second support members 2150. Thus, in this embodiment the openings formed by the first and second support members 2110, 2150 are in the shape of a rhombus/diamond. This different arrangement of the first and second support members 2110, 2150 (as compared to the arrangement of the first and second support members 110, 150 previously described) may allow for differently shaped ceiling panels to be attached thereto. Thus, as shown in FIGS. 4 and 5, the panel assemblies 2200 may have rhombus shapes, trapezoidal shapes, square shapes, triangular shapes, or the like. Such differently shaped panel assemblies 2200 cannot be readily and easily attached to the overhead grid assembly 100 which includes perpendicularly oriented support structures 110, 150. Thus, by modifying the relative positioning of the first and second support members 2110, 2150, the panel assemblies 2200 may individually and collectively define different shapes, thereby creating a different aesthetic. Such different shapes may also be needed depending on the overall shape of the space within which the suspended ceiling system 2000 is being used.

Figure 7A:
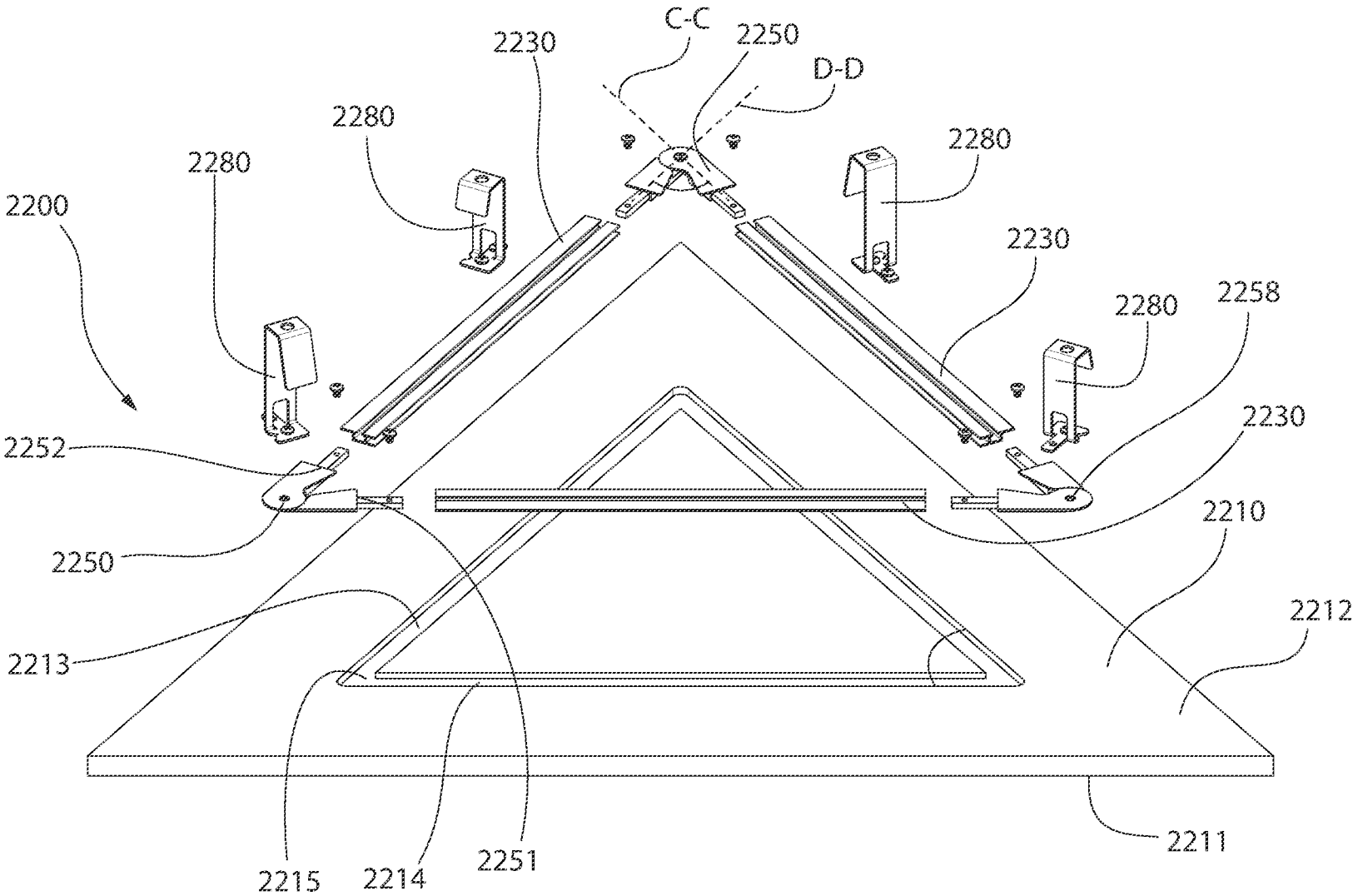
FIG. 7A is an exploded view of a panel assembly of the suspended ceiling system of FIG. 6.
Figure 7B:
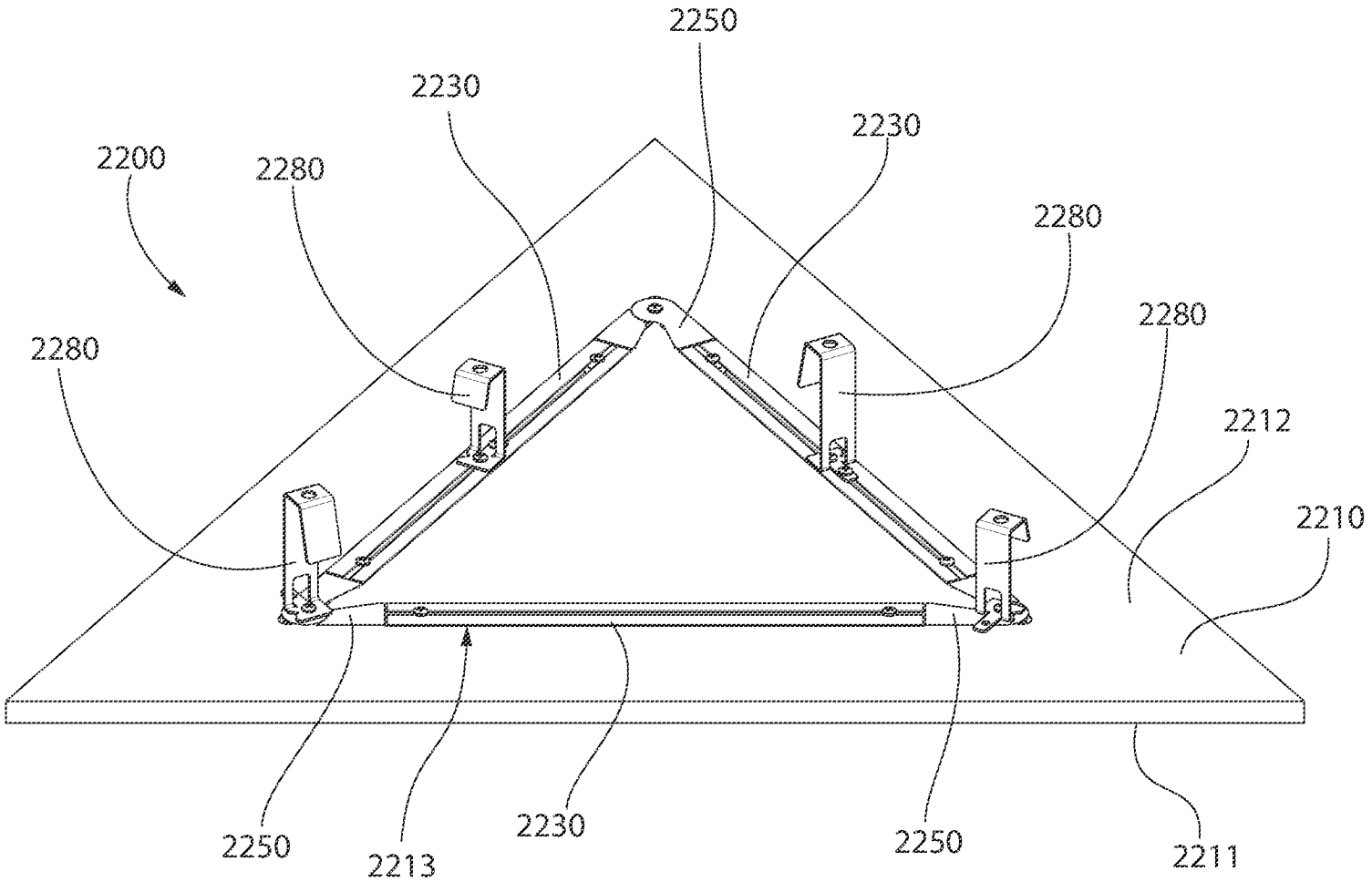
FIG. 7B is an assembled view of the panel assembly of FIG. 7A.
Figure 8:
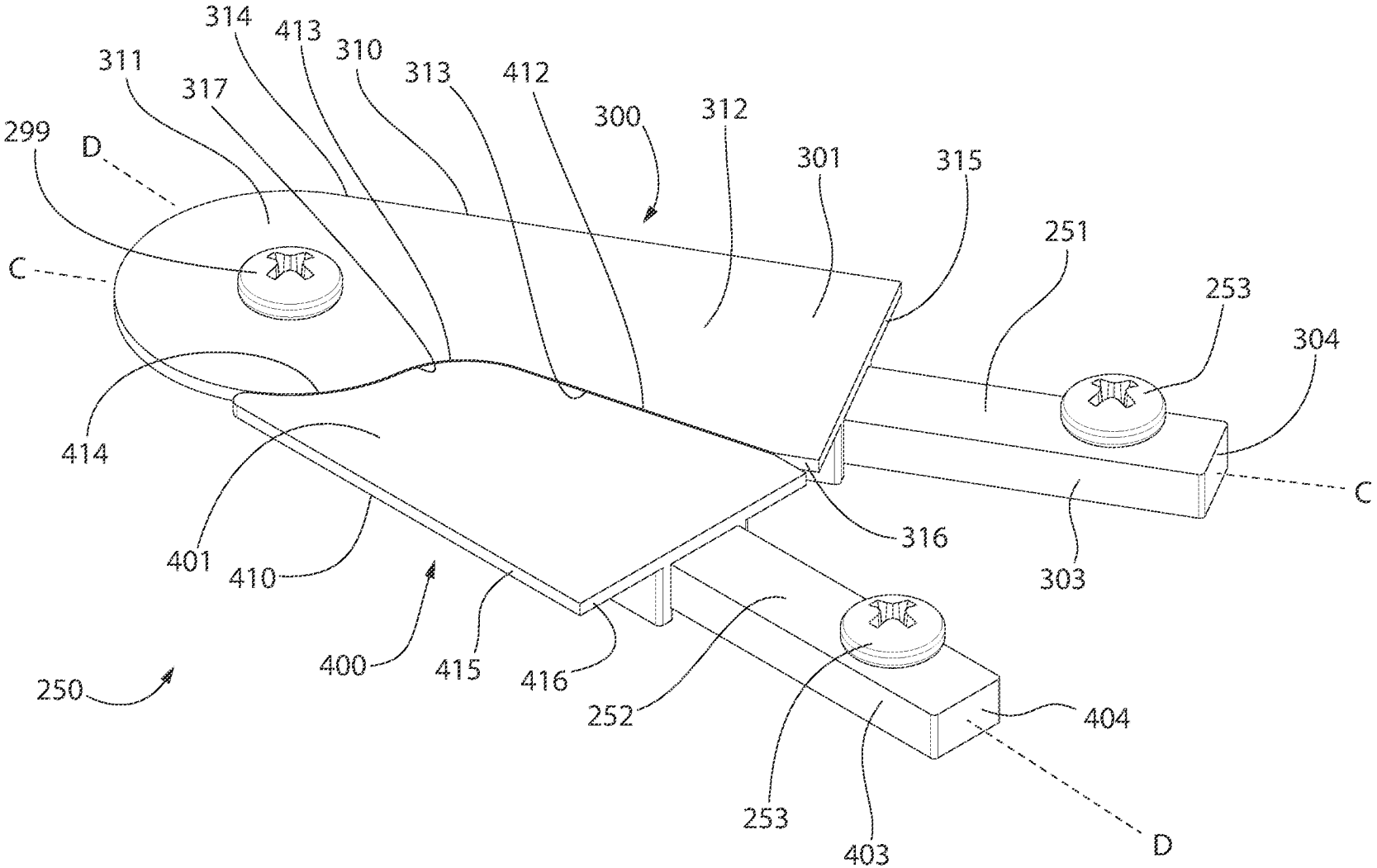
FIG. 8 is a top perspective view of a corner bracket of the suspended ceiling system of FIG. 1.
Figure 9:
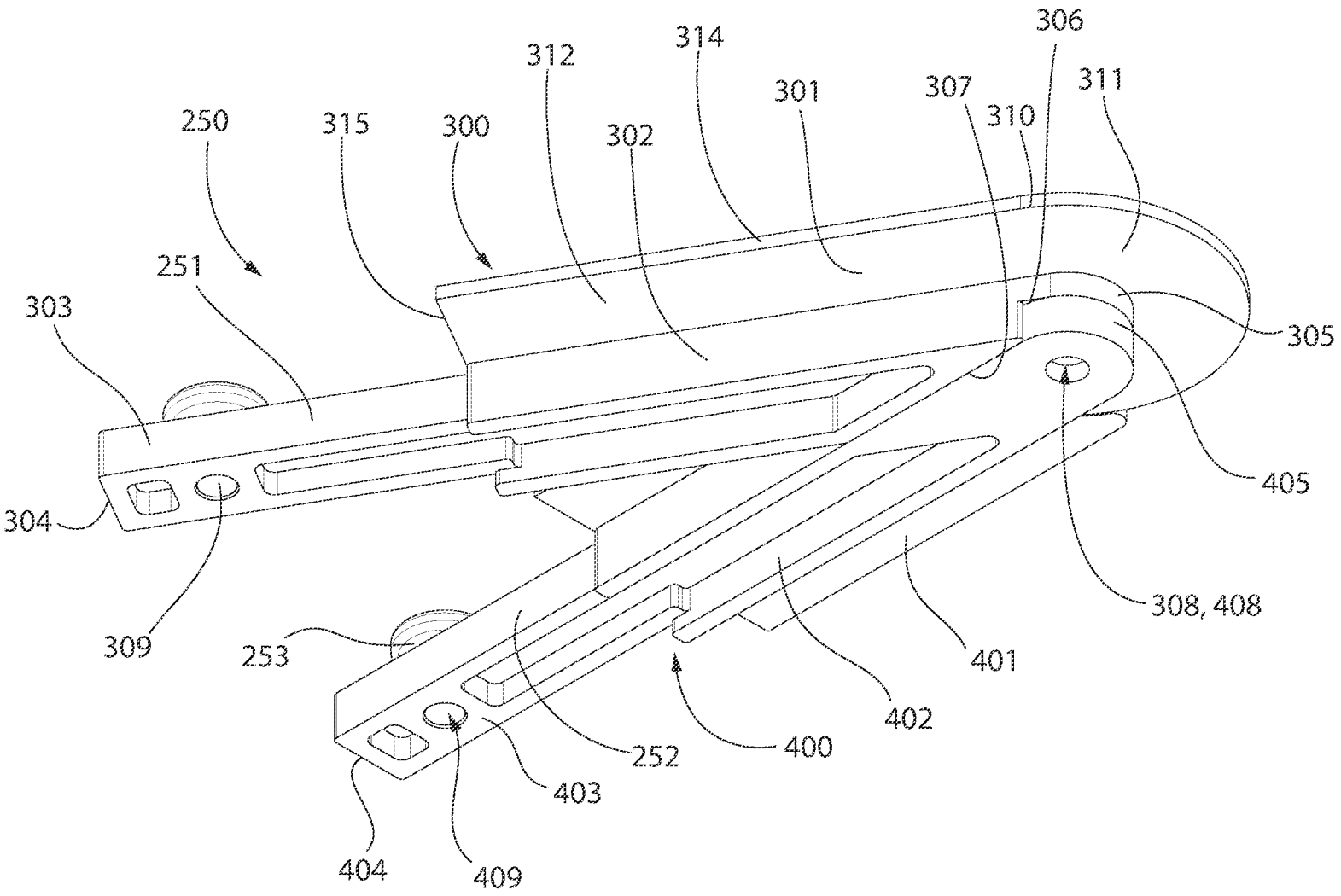
FIG. 9 is a bottom perspective view of the corner bracket of FIG. 8.
Figure 10:
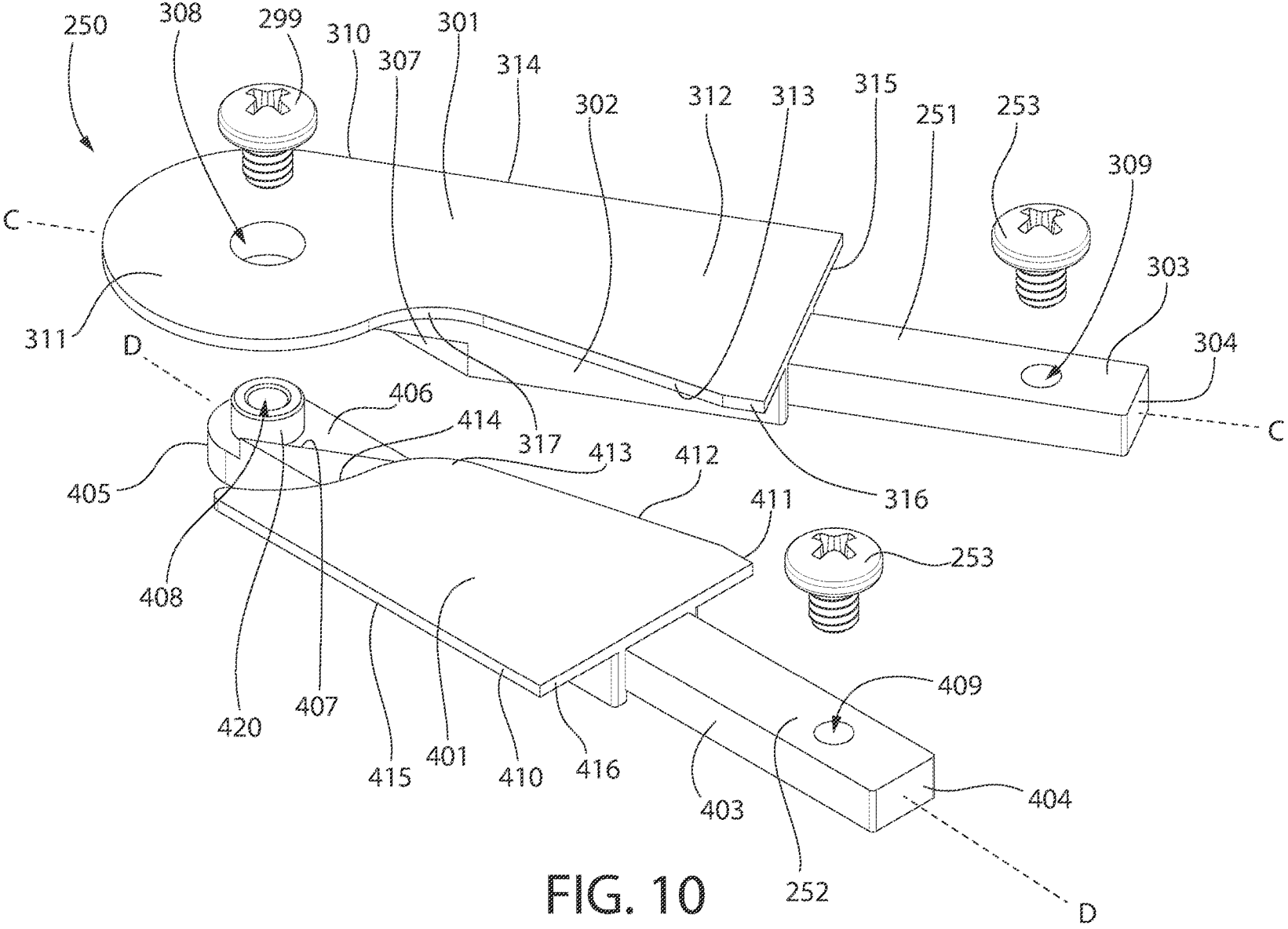
FIG. 10 is an exploded top perspective view of the corner bracket of FIG. 8.
Figure 11:
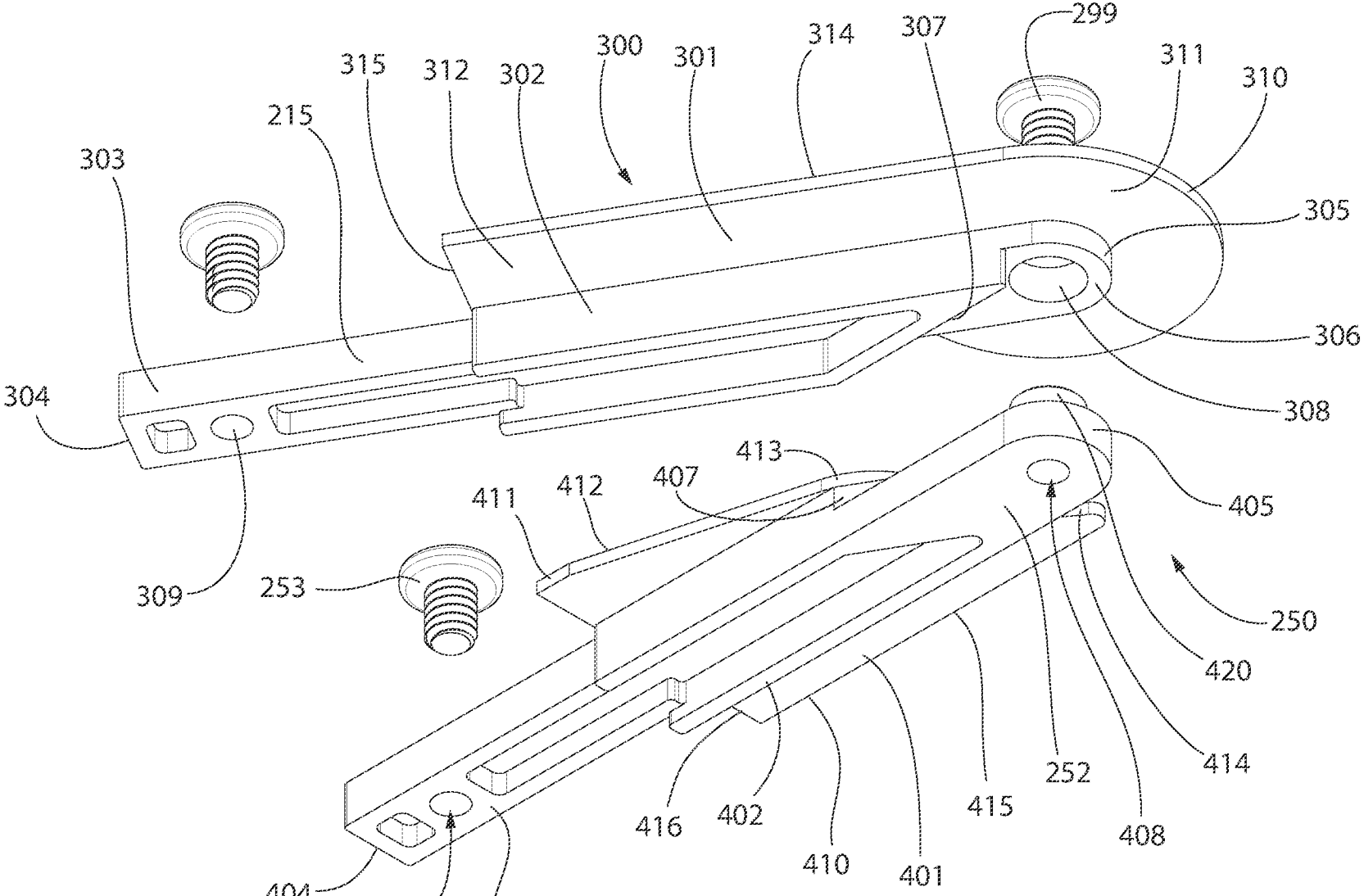
FIG. 11 is an exploded bottom perspective view of the corner bracket of FIG. 8.

Referring to FIGS. 7A and 7B, one of the panel assemblies 2200 of the suspended ceiling system 2000 shown in FIG. 6 is illustrated. The components of the panel assembly 2200 are the same as the components of the panel assembly 200 described above. In particular, the panel assembly 2200 comprises a ceiling panel 2210 and a suspension kit which includes a plurality of suspension bars 2230, a plurality of corner brackets 2250, and a plurality of hook members 2280. The ceiling panel 2210 comprises a front surface 2211 and a rear surface 2212 opposite the front surface 2211. Furthermore, a groove 2213 is formed into the rear surface 2212 of the ceiling panel 2210. In this embodiment, the ceiling panel 2210 is triangle shaped, and the groove 2213 has a matching triangular shape. However, as discussed above the shape of the groove 2213 need not match the shape of the ceiling panel 2210 in all embodiments.

In this embodiment, there are three of the suspension bars 2230, each one positioned within one of the sides 2214 of the groove 2213. Furthermore, there are three of the corner brackets 2250, each one positioned within one of the corners 2215 of the groove 2213. Finally, there are four of the hook members 2280 which are coupled either to the suspension bars 2230 as noted above or to the corner brackets 2250. One important distinction in this embodiment is that the interior angle Θ2 of the corner portions 2215 of the groove 2213 of the panel assemblies 2200 are different than the interior angle Θ1 of the corner portions 215 of the groove 213 of the panel assemblies 200 described previously (in particular, Θ1 was approximately 90° whereas Θ2 is approximately 60°). Despite this difference, the corner brackets 2250 are identical to the corner brackets 250, except with regard to the relative angle between the first and second arm portions 2251, 2252 thereof. That is, because the corner brackets 250, 2250 are adjustable to alter the angle between the first and second arm portions 2251, 2252, the same exact corner brackets 250, 2250 can be used on different ceiling panels 210, 2210 regardless of the value of the interior angles Θ1, Θ2 of its groove 213, 2213. Thus, the corner brackets 250 and the corner brackets 2250 are exactly the same component(s), with a simple adjustment being made thereto to enable its use with differently shaped grooves 213, 2213. The corner brackets 250, 2250 will now be described in detail below, and the numbering used will be commensurate with the corner brackets 250 although it should be appreciated that the same description is applicable to the corner brackets 2250 because they are the same.

Referring now to FIGS. 8-11, the corner brackets 250 will be described in detail. The corner brackets 250 comprise a first arm component 300 and a second arm component 400. The first and second arm components 300, 400 are separate and distinct from one another, and are coupled together as described herein to form the corner bracket 250. Moreover, the first and second arm components 300, 400 are coupled together in such a manner that the first arm component 300 is configured to be rotatable relative to the second arm component 400 in order to adjust an angle defined therebetween.

The first arm component 300 comprises the first arm portion 251 and a first cover portion 301. The first arm portion 251 extends along a first arm axis C-C (and in fact, the first arm component 300 extends along the first arm axis C-C). The first arm portion 251 comprises a first portion 302 that is covered by the cover portion 301 and a second portion 303 that is exposed and not covered by the cover portion 301. The cover portion 301 protrudes from the opposing sides of the first arm portion 251. As a result, the first arm portion 251 comprises dimensions that enable the first arm portion 251 to fit within the groove 213 on the rear surface 212 of the ceiling panel 210 and the cover portion 301 comprises dimensions that prevent the cover portion 301 from fitting within the groove 213 on the rear surface 212 of the ceiling panel 210. Instead, the cover portion 301 lays flat atop of the rear surface 212 of the ceiling panel 210 as best shown in FIG. 2.

The first arm portion 251 is a linear structure that extends from a first end 304 to a second end 305 along the first arm axis C-C. The first end 304 is linear and the second end 305 is rounded in the exemplified embodiment. The first arm portion 251 comprises a recessed region 306 adjacent to the second end 305 and an upstanding wall 307 that forms an endpoint of the recessed region 306. That is, the recessed region 306 extends from the second end 305 of the first arm portion 251 to the upstanding wall 307 in a direction of the first arm axis C-C.

The upstanding wall 307 is oriented at an oblique, and more specifically acute, angle relative to the first arm axis C-C. The upstanding wall 307 forms a stopper wall in that it engages the second arm component 400 when the first and second arm components 300, 400 are in a minimum angle position as will be described in greater detail below. The first arm component 300 comprises a first aperture 308 that extends through the cover portion 301 and the first arm portion 251 along the recessed region 306. The first arm component 300 also comprises a second aperture 309 that extends through the second portion 303 of the first arm portion 251 adjacent to the first end 304 thereof. The second aperture 309 is configured to receive one of the fasteners 253 described above for purposes of coupling the corner bracket 250 to the suspension bars 230.

The cover portion 301 of the first arm component 300 comprises a peripheral edge 310. Furthermore, the cover portion 301 of the first arm component 300 comprises a bulbous proximal portion 311 (located closest to the second end 305 of the first arm portion 251) and a distal portion 312 (located closest to the first end 304 of the first arm portion 251). The bulbous proximal portion 311 is rounded such that the peripheral edge 310 is arcuate along an entirety of the bulbous proximal portion 311. The first aperture 308 is located along the bulbous proximal portion 311 in the exemplified embodiment. The peripheral edge 310 of the cover portion 301 along the distal portion 312 thereof comprises a first linear portion 313 located on a first side of the first arm axis C-C, a second linear portion 314 located on a second side of the linear arm axis C-C, and a third linear portion 315 extending between the first and second linear portion 313, 314. The third linear portion 315 forms a distal-most end of the cover portion 301.

In the exemplified embodiment, the peripheral edge 310 of the cover portion 301 also comprises a fourth linear portion 316 located on the first side of the first arm axis C-C and extending from the first linear portion 313 to the third linear portion 315 and a concave portion 317 located between the first linear portion 313 and the bulbous proximal portion 311. However, in some embodiments the fourth linear portion 316 and the concave portion 317 could be omitted. In the exemplified embodiment, the fourth linear portion 316 extends from the third linear portion 315 in a direction that is parallel to the first arm axis C-C. The first linear portion 313 extends from the fourth linear portion 316 in a direction that is angled relative to the first arm axis C-C. Thus, in particular, the first linear portion 313 extends along an axis that intersects the first arm axis C-C at an acute angle. In the exemplified embodiment, the first linaer portion 313 extends along an axis that intersects the first arm axis C-C at an angle of approximately 15° (although the exact angle can be modified in other embodiments). The first and second linear portions 313, 314 interact/mate/abut portions of the second arm component 400 when in the minimum and maximum angle positions as described in greater detail below.

The second arm component 400 comprises the second arm portion 252 and a second cover portion 401. The second arm portion 252 extends along the second arm axis D-D as noted above. The second arm portion 252 comprises a first portion 402 that is covered by the cover portion 401 and a second portion 403 that is exposed and not covered by the cover portion 401. The cover portion 401 protrudes from the opposing sides of the second arm portion 252. As a result, the second arm portion 252 comprises dimensions that enable the second arm portion 252 to fit within the groove 213 on the rear surface 212 of the ceiling panel 210 and the cover portion 401 comprises dimensions that prevent the cover portion 401 from fitting within the groove 213 on the rear surface 212 of the ceiling panel 210. Instead, the cover portion 401 lays flat atop of the rear surface 212 of the ceiling panel 210 as best shown in FIG. 2.

The second arm portion 252 is a linear structure that extends from a first end 404 to a second end 405 along the second arm axis D-D. The first end 404 is linear and the second end 405 is rounded in the exemplified embodiment. The second arm portion 252 comprises a recessed region 406 adjacent to the second end 405 and an upstanding wall 407 that forms an endpoint of the recessed region 407. That is, the recessed region 406 extends from the second end 405 of the second arm portion 252 to the upstanding wall 407 in a direction of the first arm axis D-D.

The upstanding wall 407 is oriented at an oblique, and more specifically acute, angle relative to the second arm axis D-D. The upstanding wall 407 forms a stopper wall in that it engages the first arm component 300 when the first and second arm components 300, 400 are in a minimum angle position as will be described in greater detail below. The second arm component 400 comprises a first aperture 408 that extends through the cover portion 401 and the second arm portion 252 along the recessed region 406. The second arm component 400 also comprises a second aperture 409 that extends through the second portion 403 of the second arm portion 252 adjacent to the first end 404 thereof. The second aperture 409 is configured to receive one of the fasteners 253 described above for purposes of coupling the corner bracket 250 to the suspension bars 230.

The second arm component 400 also comprises an annular wall 420 that surrounds the first aperture 408. The annular wall 420 protrudes from the floor of the recessed region 406 to a distal end. The annular wall 420 is a continuous wall in the exemplified embodiment such that its inner surface faces and defines the first aperture 408.

The cover portion 401 of the second arm component 400 comprises a peripheral edge 410. Furthermore, the peripheral edge 410 comprises a first linear portion 411 on a first side of the second arm axis D-D, a second linear portion 412 on the first side of the second arm axis D-D, a convex portion 413, a concave portion 414, a third linear portion 415 on a second side of the second arm axis D-D, and a fourth linear portion 416 that extends between the first and third linear portion 411, 415 and forms a distal-most end of the cover portion 401. Of course, the cover portion 401 could have a somewhat altered shape in other embodiments and the specific structure and shape of the cover portion 401 is not to be limiting of the invention in all embodiments. However, the cover portion 401 has a shape that ensures that portions of the peripheral edge 410 thereof contact portions of the peripheral edge 310 of the cover portion 301 of the first arm component 300 when the first and second arm components 300, 400 are in minimum and maximum angle positions to dictate the bound the degree of relative rotation therebetween.

When the first and second arm components 300, 400 are coupled together, the annular wall 420 of the second arm component 400 nests within the first aperture 308 of the first arm component 308. Furthermore, the recessed regions 306, 406 of the first and second arm components 300, 400 are aligned so that a floor of the recessed region 306 of the first arm component 300 contacts a floor of the recessed region 406 of the second arm component 400. Moreover, the first aperture 408 of the second arm component 400 is aligned with the first aperture 408 of the first arm component 300. A fastener 299 may be inserted into and through the first apertures 308, 408 of the first and second arm components 300, 400 as shown in FIGS. 8-11. The fastener 299 may be a screw as shown in the exemplified embodiment, although the invention is not to be so limited in all embodiments and the fastener 299 may be a different type of hardware in other embodiments. The fastener 299 may be alterable between an unlocked state whereby the first and second arm components 300, 400 are able to rotate relative to one another and a locked state whereby the first and second arm components 300, 400 are prevented from rotating relative to one another. For example, a user or installer may loosen the fastener (screw) 299, which will allow for the first arm component 300 to be rotated relative to the second component 400 even while the annular wall 420 remains nested within the first aperture 308 of the first arm component 300. Upon positioning the first arm component 300 in the desired angular position relative to the second arm component 400, the user/installer may tighten the fastener 299 to prevent further relative rotation between the first and second arm components 300, 400.

Furthermore, the peripheral edge 310 of the cover portion 301 of the first arm component 300 located along the bulbous proximal portion 311 thereof nests within the concave portion 414 of the peripheral edge 410 of the cover portion 401 of the second arm component 400. The exact section of the peripheral edge 310 of the bulbous proximal portion 311 which nests within the concave portion 414 of the peripheral edge 410 of the cover portion 401 changes as the first arm component 300 is rotated relative to the second arm component 400, but the rounded shapes in these regions facilitates the ability of the first and second arm components 300, 400 to rotate relative to one another as illustrated and described herein.

Figure 12A:
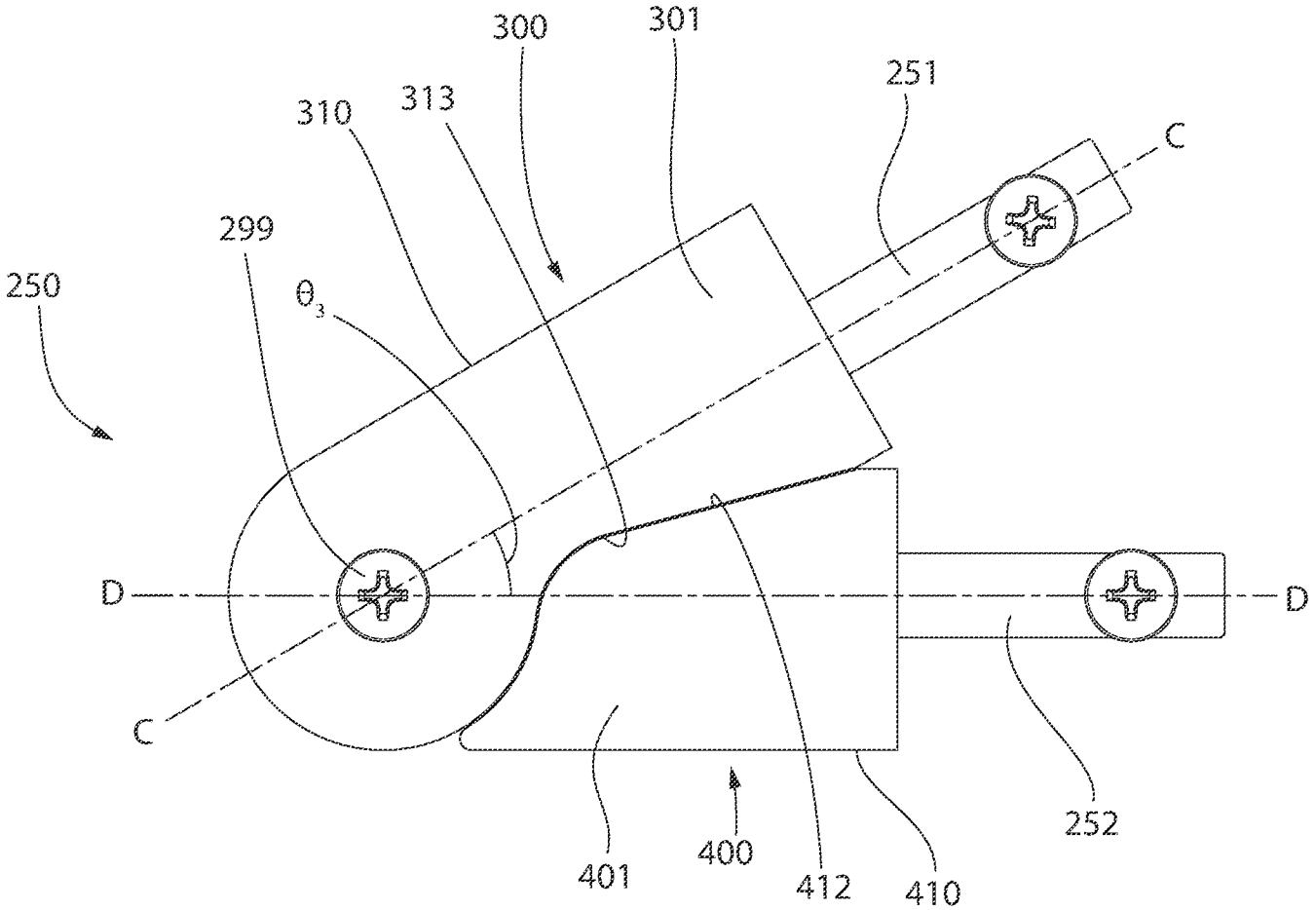
FIGS. 12A-12F are top views of the corner bracket of FIG. 8 illustrating the rotation of a first arm component thereof relative to a second arm component thereof.

Referring to FIGS. 12A-12F in succession, the relative rotational movement of the first arm component 300 relative to the second arm component 400 will be described. FIG. 12A illustrates the corner bracket 250 with the first and second arm components 300, 400 in a minimum angle position. In the minimum angle position, the first arm axis C-C of the first arm component 400 is oriented at an angle Θ3 of approximately 30° relative to the second arm axis D-D of the second arm component 300. In this position, various portions of the peripheral edges 310, 410 of the cover portions 301, 401 of the first and second arm components 300, 400 abut against each other to prevent the first and second arm components 300, 400 from being rotated so that the angle Θ3 is less than approximately 30°. It is noted here that the term "approximately" as used with regard to a particular angle measurement includes angles of plus or minus 5° relative to the given angle measurement.

In the minimum angle position shown in FIG. 12A, the first linear portion 313 of the peripheral edge 310 of the cover portion 301 of the first arm component 300 abuts against the second linear portion 412 of the peripheral edge 410 of the cover portion 401 of the second arm component 400. Due to this engagement, the first arm component 300 cannot be rotated any further in the clockwise direction shown in FIG. 12A. Thus, in the position shown in FIG. 12A (the minimum angle position), the angle Θ3 is the smallest possible angle that can be formed between the first and second arm axes C-C, D-D with the shape and structures of the first and second cover portions 301, 401 in accordance with the exemplified embodiment.

As discussed above, in the exemplified embodiment the first linear arm portion 313 abuts against the first linear arm portion 412 when the first and second arm components 300, 400 are in the minimum angle position. Moreover, in the exemplified embodiment the first linear arm portion 313 and the first linear arm portion 412 are linear. However, the invention is not to be so limited and the first and second linear arm portions 313, 412 could be wavy in other embodiments such that the intermesh when moved into contact with each other. In still other embodiments, the first and second linear arm portions 313, 412 may not even contact each other when in the minimum angle position, but rather a tab or protrusion may extend from the peripheral edge 310, 410 of the cover portion 301, 401 of one of the first and second arm components 300, 400 to abut against the other to prevent further reduction of the angle Θ3 and dictate the minimum angle position. Thus, variations in the structures of the first and second arm components 300, 400 are possible within the scope of the invention claimed herein while still achieving the functionality described herein.

As discussed above, the first and second arm components 300, 400 can be rotated relative to each other so that the corner bracket 250 can be used with differently shaped grooves 213 in differently shaped ceiling panels 210. In particular, when in the relative position shown in FIG. 12A, the corner bracket 250 can be positioned within a groove 213 having an interior angle of approximately 30°. Specifically, the interior angle of the groove must match the angle Θ3 between the first and second arm axes C-C, D-D in order for the corner bracket 250 to be properly positioned within the groove 213 along a given corner thereof. However, in some instances none of the interior angles of the groove may match the angle Θ3 shown in FIG. 12A, and thus the angle Θ3 would need to be adjusted prior to inserting the corner bracket 250 into that particular groove. Thus, a user or installed would simply loosen the fastener 299 to enable the user or installer to rotate the first arm component 300 relative to the second arm component 400.

Figure 12B:
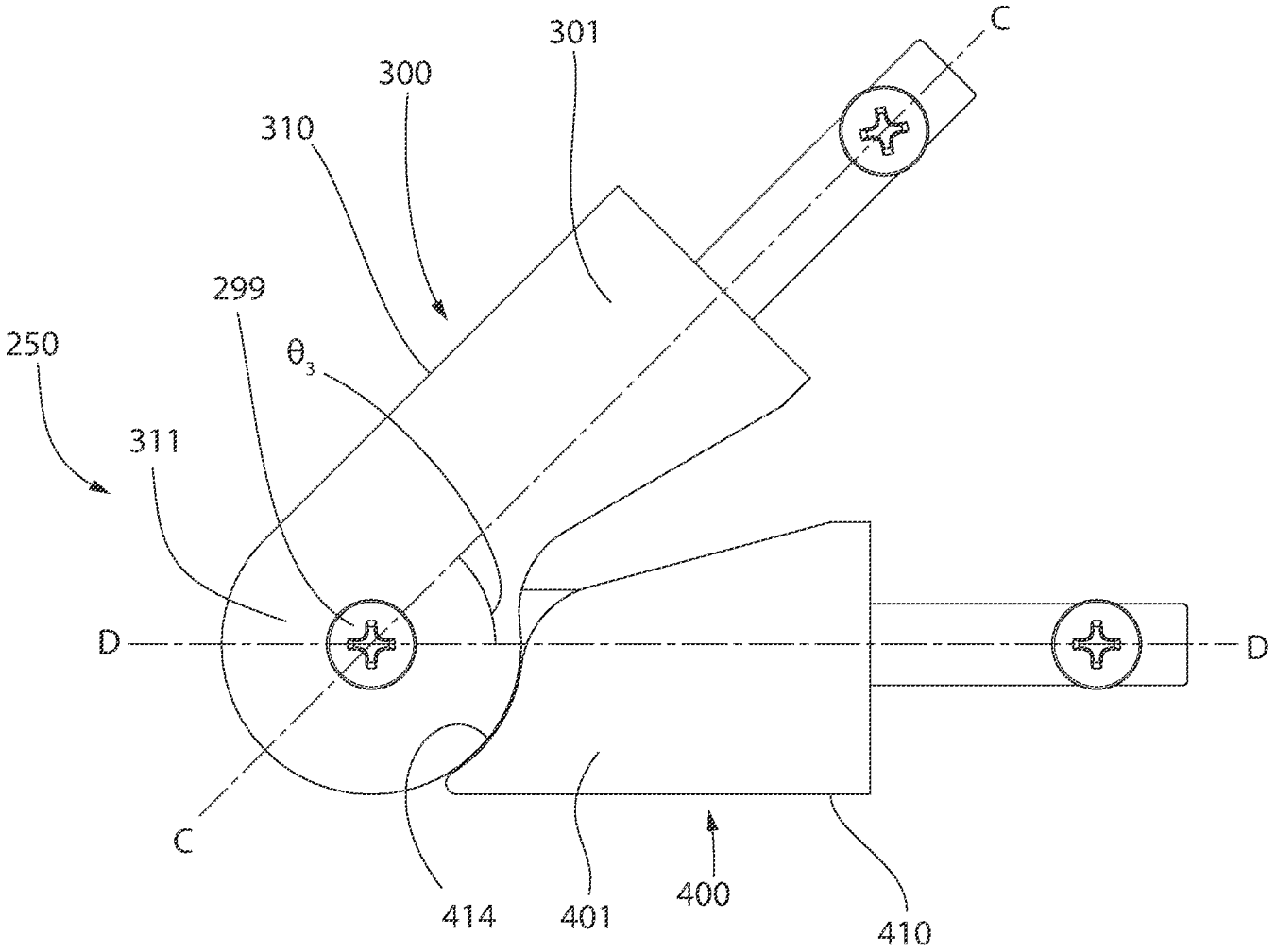

FIG. 12B illustrates the corner bracket 250 after the first arm component 300 has been rotated in a counterclockwise direction relative to the second arm component 400. The peripheral edge 310 of the cover portion 301 of the first arm component 300 located along the bulbous proximal portion 311 thereof still nests within the concave portion 414 of the peripheral edge 410 of the cover portion 401 of the second arm component 400. However, other than that the peripheral edges 310, 410 of the cover portions 301, 401 of the first and second arm components 300, 400 are not in contact in FIG. 12B. In FIG. 12B, the angle Θ3 between the first and second arm axes C-C, D-D is approximately 45°. Thus, the corner bracket 250 may be adjusted to this position for purposes of inserting the corner bracket 250 within a groove in a ceiling panel along a 45° corner thereof.

Figure 12C:
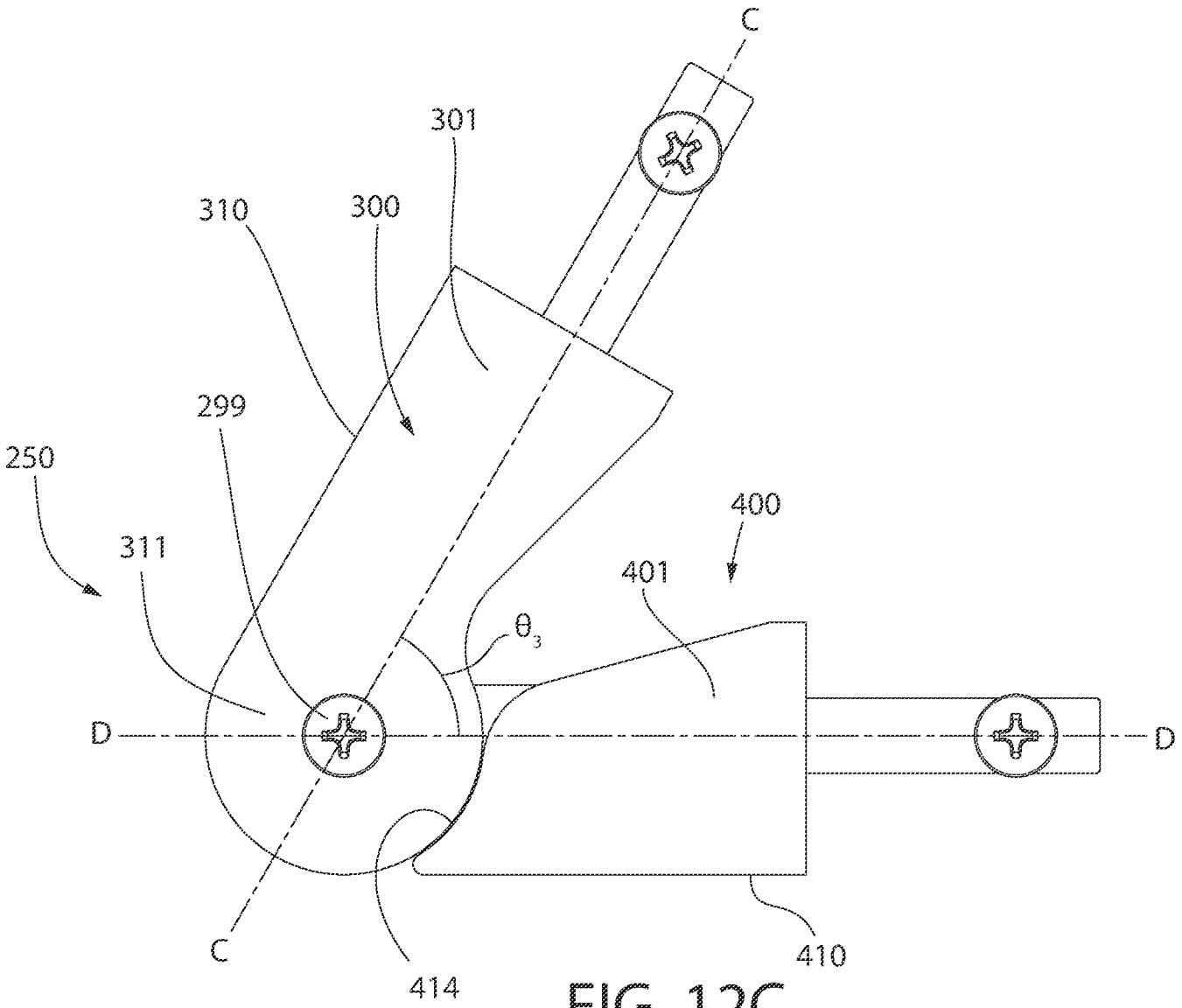

Next, referring to FIG. 12C, the corner bracket 250 has been further adjusted by rotating the first arm component 300 an additional distance in the counterclockwise direction relative to the second arm component 400. Again, a portion of the peripheral edge 310 of the cover portion 301 of the first arm component 300 located along the bulbous proximal portion 311 thereof still nests within the concave portion 414 of the peripheral edge 410 of the cover portion 401 of the second arm component 400 (although the exact portion of the peripheral edge 310 changes somewhat as the first arm component 300 is made to rotate relative to the second arm component 400). In the position shown in FIG. 12C, the angle Θ3 between the first and second arm axes C-C, D-D is approximately 60°. Thus, the corner bracket 250 may be adjusted to this position for purposes of inserting the corner bracket 250 within a groove in a ceiling panel along a 60° corner thereof (such as one of the corner portions 2215 of the groove 2213 of the ceiling panel 2210 shown in FIGS. 7A and 7B).

Figure 12D:
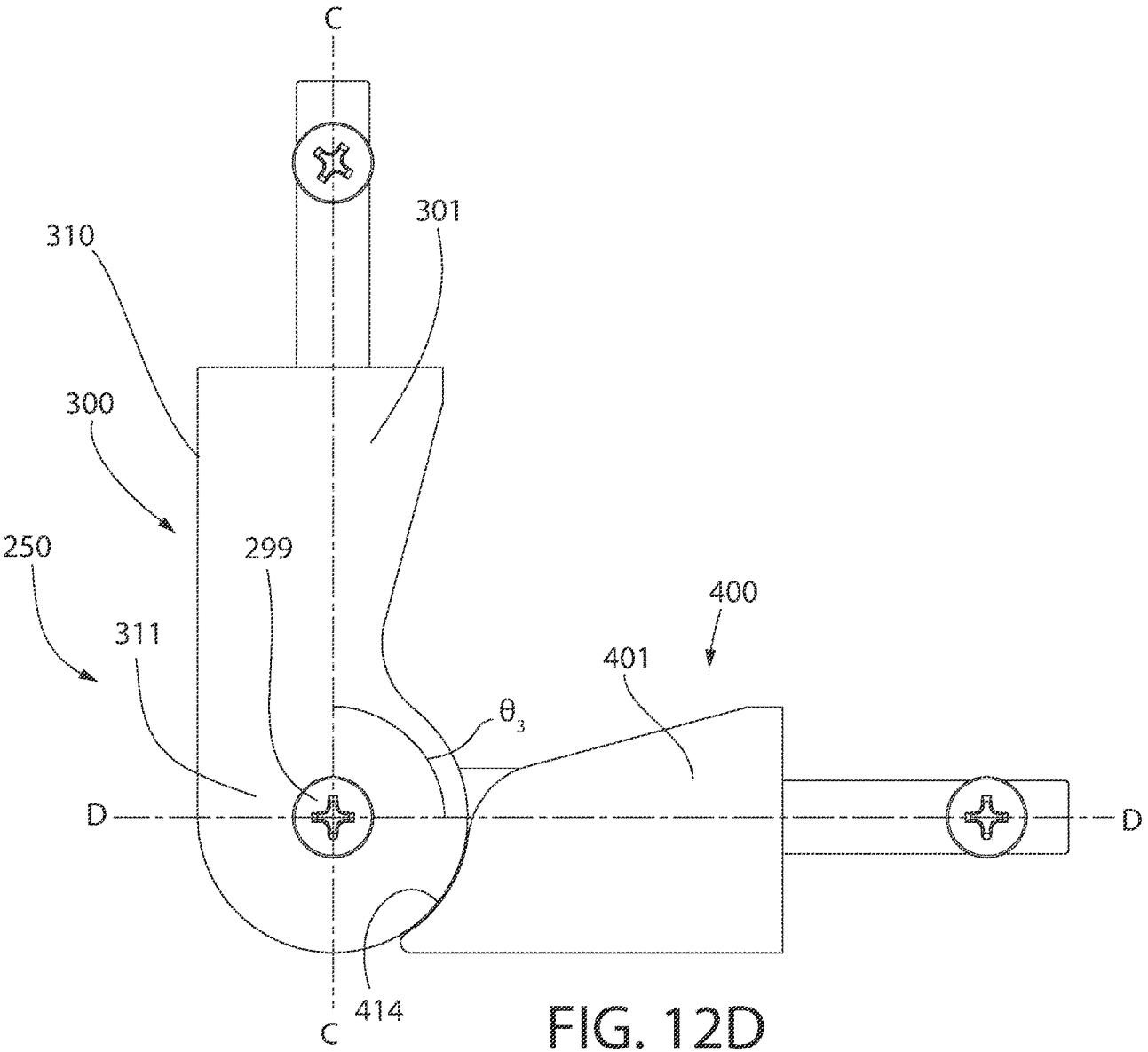

Next, referring to FIG. 12D, the corner bracket 250 has been still further adjusted by rotating the first arm component 300 an additional distance in the counterclockwise direction relative to the second arm component 400. Although FIGS. 12A-12F are described with regard to movement of the first arm component 300 relative to the second arm component 400, it should be appreciated that the same adjustments can be achieved by moving the second arm component 400 relative to the first arm component 300 or moving each of the first and second arm components 300, 400 relative to each other. In FIG. 12D, a portion of the peripheral edge 310 of the cover portion 301 of the first arm component 300 located along the bulbous proximal portion 311 thereof still nests within the concave portion 414 of the peripheral edge 410 of the cover portion 401 of the second arm component 400. In the position shown in FIG. 12D, the angle Θ3 between the first and second arm axes C-C, D-D is approximately 90°. Thus, the corner bracket 250 may be adjusted to this position for purposes of inserting the corner bracket within a groove of a ceiling panel along a 90° corner thereof (such as one of the corner portions 215 of the groove 213 of the ceiling panel 210 shown in FIGS. 3 and 4).

Figure 12E:
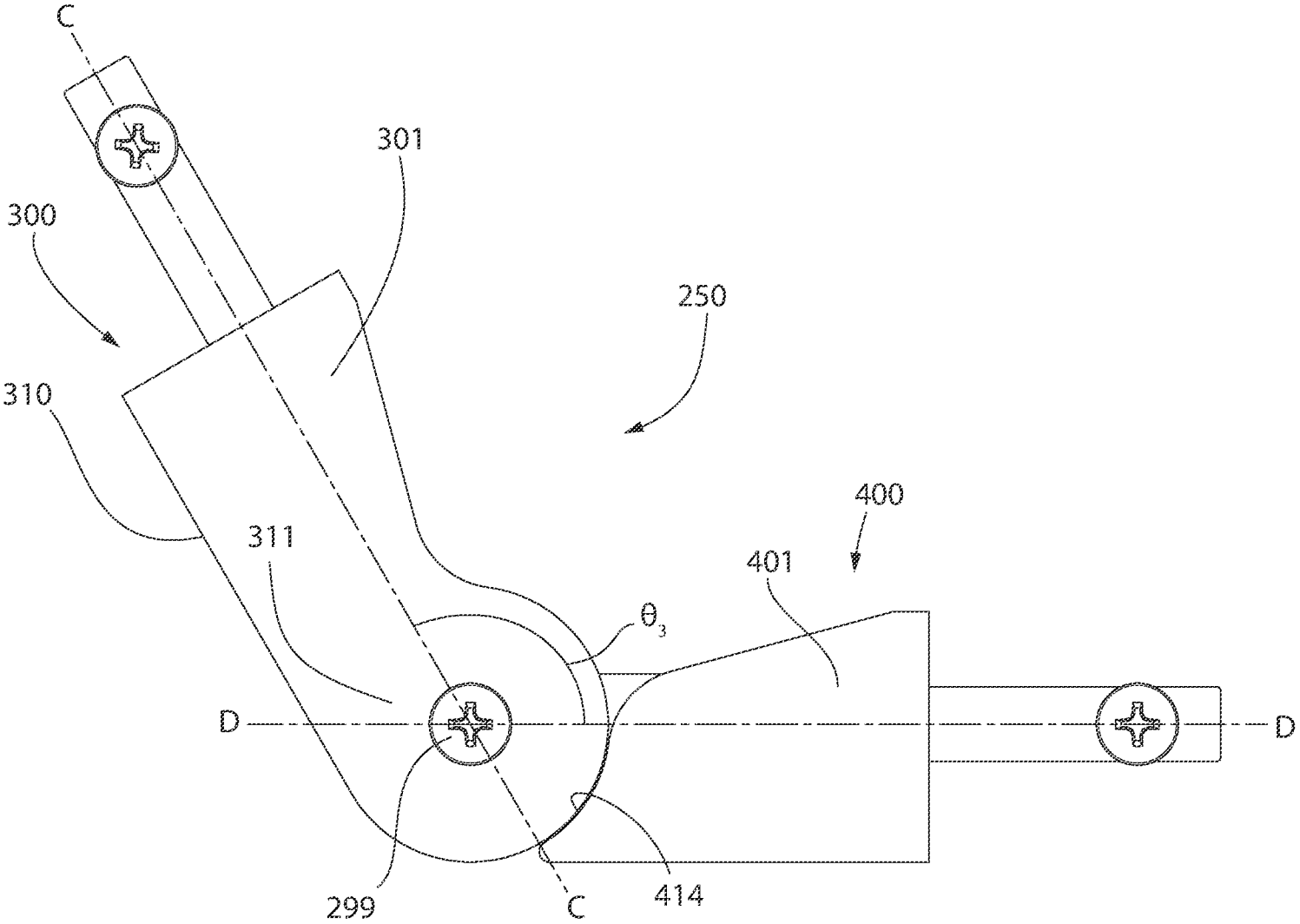

Referring to FIG. 12E, the first arm component 300 has been rotated counterclockwise even further. In FIG. 12E, the angle Θ3 between the first and second arm axes C-C, D-D is approximately 120°. The first and second arm components 300, 400 remain coupled together due to the positioning of the fastener 299 within the apertures 308, 408 of the first and second arm components 300, 400 as described above. As described above, the first and second arm components 300, 400 can be locked into the position shown in FIG. 12E by tightening the fastener 299, thereby altering the fastener 299 into a locked position. Once the first and second arm components 300, 400 are locked as indicated, they form a rigid frame together with the suspension bars 230 which is locked in the groove 213.

Figure 12F:
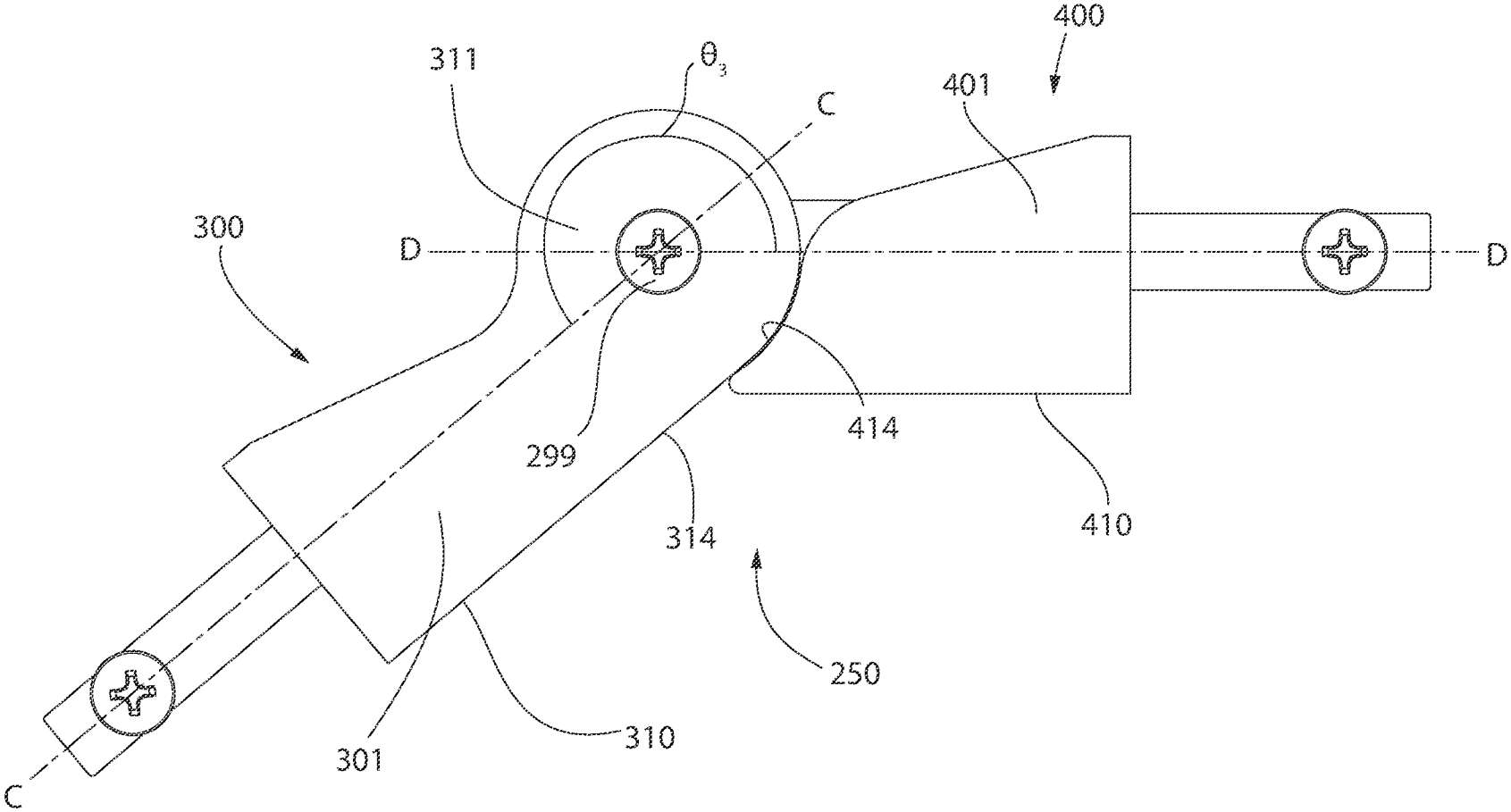

Finally, FIG. 12F illustrates the first arm component 300 rotated counterclockwise again so that the first and second arm components 300 is in a maximum angle position. In particular, in FIG. 12F the first arm component 300 has been rotated to the position where it can not be further rotated relative to the second arm component 400 in the counterclockwise direction. In the maximum angle position of the first and second arm components 300, 400 as shown in FIG. 12F, the angle Θ3 between the first and second arm axes C-C, D-D is approximately 220°. In the maximum angle position, a portion of the concave portion 414 of the peripheral edge 410 of the cover portion 401 of the second arm component 400 abuts against a portion of the second linear portion 314 of the peripheral edge 310 of the cover portion 301 of the first arm component 300. Due to the abutment between the cover portions 301, 401 of the first and second arm components 300, 400 as shown, the first arm component 300 is prevented from further rotating in the counterclockwise direction relative to the second arm component 400. Thus, the position shown in FIG. 12F whereby the first and second arm axes C-C, D-D intersect at an approximately 200° angle is the maximum angle position of the first and second arm components 300, 400. In alternative embodiments, the shapes of the first and second arm components 300, 400, and more specifically the cover portions 301, 401 thereof, could be modified so that the minimum and maximum angle positions and the range of angles for Θ3 may be modified or changed to be different from that which has been shown and described herein.

Referring to FIGS. 3 and 7A concurrently, the panel assemblies 200, 2200 are illustrated, respectively. As shown in FIG. 3, the ceiling panel 210 of the panel assembly 200 comprises the groove 213 which has interior angles Θ1 which are approximately 90°. Thus, the corner brackets 250 are adjusted so that the angle Θ3 between the first and second arm axes C-C, D-D is also approximately 90° to match the interior angles Θ1. As shown in FIG. 7A, the ceiling panel 2210 of the panel assembly 2200 comprises the groove 2213 which has interior angles Θ2 which are approximately 60°. Thus, the corner brackets 2250 are adjusted so that the angle Θ3 between the first and second arm axes C-C, D-D is also approximately 60° to match the interior angles Θ2. It should be appreciated that the corner brackets 250, 2250 must be adjusted to the desired angle Θ3 prior to inserting the corner brackets 250, 2250 into the grooves 213, 2213 of the ceiling panels 210, 2210. Alternatively, the corner brackets 250, 2250 can be adjusted as they are being inserted into the grooves 213, 2213, and then the fasteners299 tightened thereafter. The corner brackets 250 and the corner brackets 2250 are identical including comprising the same components and structural details, except the corner brackets 2250 have been adjusted relative to the corner brackets 250 to reduce the angle Θ3 as discussed above with reference to FIGS. 12A-12F.

Referring to FIGS. 3 and 4A, the corner brackets 250 are positioned so that the second portions 303, 403 of the first and second arm portions 251, 252 nest within the channels 240 of the suspension bars 230. Furthermore, the linear portions 315, 416 of the cover portions 301, 401 of the first and second arm components 300, 400 abut against the ends of respective ones of the suspension bars 230. The second portions 303, 403 of the first and second arm portions 251, 252 are then coupled to the suspension bars 230 with the fasteners 253. This ensures that the corner brackets 250 and the suspension bars 230 remain in place disposed within the groove 213 even when the panel assemblies 200 are hanging from an overhead grid assembly 100.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A panel assembly for a suspended ceiling system, the panel assembly comprising:

a ceiling panel comprising a front surface, a rear surface opposite the front surface, and a groove formed into the rear surface, the groove comprising a plurality of sides and a plurality of corners;

a plurality of suspension bars configured to be disposed within the groove of the ceiling panel along the sides thereof, each of the suspension bars defining a channel;

a plurality of corner brackets, each of the corner brackets comprising a first arm component extending along a first arm axis and a second arm component extending along a second arm axis and being coupled to the first arm component, wherein the corner brackets are adjustable to alter an angle measured between the first and second arm axes, and wherein the corner brackets are configured to be disposed within the groove of the ceiling panel along the corners thereof so that for each of the corner brackets, the first arm component at least partially nests within the channel of a first one of the suspension bars and the second arm component at least partially nests within the channel of a second one of the suspension bars; and wherein the corner brackets are adjustable to alter the angle measured between the first and second arm axes between a minimum angle and a maximum angle, wherein the first and second arm components abut one another to prevent the angle from being adjusted to below the minimum angle or above the maximum angle, and wherein the minimum angle is an acute angle of approximately 30°.

2. The panel assembly according to claim 1 wherein the groove in the rear surface of the ceiling panel is a continuous groove that forms a polygonal shape.

3. The panel assembly according to claim 1 wherein the first arm component of the corner brackets comprises a first arm portion comprising a first portion that is configured to be disposed within a first one of the sides of the groove without nesting within the channel of any of the suspension bars and a second portion that is configured to nest within the channel of the first one of the suspension bars, and wherein the second arm portion component of the corner brackets comprises a second arm portion comprising a first portion that is configured to be disposed within a second one of the sides of the groove without nesting within the channel of any of the suspension bars and a second portion that is configured to nest within the channel of the second one of the suspension bars.

4. The panel assembly according to claim 1 wherein the groove in the rear surface of the ceiling panel comprises an undercut portion that is positioned beneath a lip, and wherein each of the suspension bars comprises a projecting flange portion that is configured to nest within the undercut portion to couple the suspension bars to the ceiling panel.

5. The panel assembly according to claim 1 further comprising a plurality of hook members configured to be coupled to the suspension bars so as to protrude from the rear surface of the ceiling panel, wherein the hook members are configured to engage support members of an overhead grid assembly to hang the panel assembly therefrom.

6. The panel assembly according to claim 1 wherein the maximum angle is 220°.

7. The panel assembly according to claim 1 wherein each of the corner brackets comprises:

the first arm component comprising a first aperture;

the second arm component comprising a second aperture, the first and second arm components being coupled together so that the first aperture of the first arm component is aligned with the second aperture of the second arm component; and wherein the first arm component is rotatable relative to the second arm component about a rotational axis that intersects the first and second apertures.

8. The panel assembly according to claim 7 further comprising a fastener disposed within the first aperture of the first arm component and the second aperture of the second arm component for coupling the first arm component to the second arm component, wherein the fastener is alterable between an unlocked state whereby the first and second arm components are able to rotate relative to one another and a locked state whereby the first and second arm components are prevented from rotating relative to one another.

9. The panel assembly according to claim 7 wherein the first arm component is rotatable relative to the second arm component between a minimum angle position wherein the angle is the minimum angle and a maximum angle position wherein the angle is the maximum angle, and wherein the first and second arm components comprise first abutment surfaces that abut against each other when the first and second arm components are at the minimum angle position to prevent the first and second arm components from rotating to a position wherein the angle is less than the minimum angle, and wherein the first and second arm components comprise second abutment surfaces that abut against each other when the first and second arm components are at the maximum angle position to prevent the first and second arm components from rotating to a position where the angle is greater than the maximum angle.

10. The panel assembly according to claim 7 further comprising:

the first arm component comprising a first arm portion and a first cover portion, the first arm portion having dimensions that fit within the groove on the rear surface of the ceiling panel and the first cover portion having dimensions that do not fit within the groove on the rear surface of the ceiling panel, the first cover portion comprising a peripheral edge;

the second arm component comprising a second arm portion and a second cover portion, the second arm portion having dimensions that fit within the groove on the rear surface of the ceiling panel and the second cover portion having dimensions that do not fit within the groove on the rear surface of the ceiling panel, the second cover portion comprising a peripheral edge; and wherein when the first and second arm components are in a minimum angle position a first portion of the peripheral edge of the first cover portion contacts a first portion of the peripheral edge of the second cover portion, and when the first and second arm components are in a maximum angle position a second portion of the peripheral edge of the first cover portion contacts a second portion of the peripheral edge of the second cover portion; and wherein the first cover portion has a different shape than the second cover portion.

11. The panel assembly according to claim 10 further comprising:

the first cover portion of the first arm component comprising a bulbous proximal portion and a distal portion, the peripheral edge of the first cover portion along the distal portion comprising a first linear portion located on a first side of the first arm axis and a second linear portion located on a second side of the first arm axis, the first linear portion being angled away from the first arm axis with increasing distance from the bulbous proximal portion and the second linear portion being parallel to the first arm axis;

the peripheral edge of the second cover portion of the second arm component comprising a concave proximal portion and a first linear portion located on a first side of the first arm axis, the first linear portion being angled away from the second arm axis with increasing distance from the concave proximal portion;

wherein when the first and second arm components are in the minimum angle position a first portion of the bulbous proximal portion of the first cover portion nests within the concave proximal portion of the peripheral edge of the second cover portion and the first linear portion of the peripheral edge of the first cover portion abuts against the first linear portion of the peripheral edge of the second cover portion to prevent further rotation of the first arm component relative to the second arm component in a first rotational direction; and wherein when the first and second arm components are in the maximum angle position a second portion of the bulbous proximal portion of the first cover portion nests within the concave proximal portion of the peripheral edge of the second cover portion and the concave proximal portion of the peripheral edge of the second cover portion abuts against the second linear portion of the peripheral edge of the first cover portion to prevent further rotation of the first arm component relative to the second arm component in a second rotational direction that is opposite the first rotational direction.

12. A method of assembling a panel assembly of a suspended ceiling system, the method comprising:

adjusting a plurality of corner brackets so that an angle measured between a first arm axis of a first arm component and a second arm axis of a second arm component of each of the corner brackets matches an interior angle of a polygon-shaped groove formed into a rear surface of a ceiling panel; and inserting the plurality of corner brackets and a plurality of suspension bars into the polygon-shaped groove in the rear surface of the ceiling panel, wherein the corner brackets are positioned along corners of the polygon-shaped groove and the suspension bars are positioned along sides of the polygon-shaped groove; and wherein the corner brackets are adjustable to alter the angle measured between the first and second arm axes between a minimum angle and a maximum angle, wherein the first and second arm components abut one another to prevent the angle from being adjusted to below the minimum angle or above the maximum angle, and wherein the minimum angle is an acute angle of approximately 3020 .

13. The method according to claim 12 further comprising attaching at least one hook member to each of the plurality of suspension bars, wherein the hook members comprise hook portions that are configured to engage an overhead grid assembly to hang the panel assembly therefrom.

14. The method according to claim 12 wherein the first arm component comprises a first aperture that is aligned with a second aperture of the second arm component when the first and second arm components are coupled together, and further comprising a fastener extending into each of the first and second apertures, the fastener adjustable between an unlocked state whereby the first and second arm components are able to rotate relative to one another and a locked state whereby the first and second arm components are prevented from rotating relative to one another.

15. The method according to claim 12 wherein the maximum angle is 220° , wherein when the angle is 30° a first linear edge portion of the first arm component abuts a second linear edge portion of the second arm component to prevent the angle from being adjusted to below 30° , and wherein when the angle is 220° a portion of the second arm component abuts a third linear edge portion of the first arm component to prevent the angle from being adjusted to above 220° , and wherein the first linear edge portion is angled relative to the first arm axis and the third linear edge portion is parallel to the first arm axis.

16. A panel assembly for a suspended ceiling system, the panel assembly comprising:

a ceiling panel comprising a front surface and a rear surface opposite the front surface;

a plurality of suspension bars configured to be attached to the rear surface of the ceiling panel, each of the suspension bars defining a channel;

a plurality of corner brackets, each of the corner brackets comprising:

a first arm component extending along a first arm axis and comprising a first arm portion and a first cover portion, the first cover portion protruding from opposing lateral sides of the first arm portion and having a first peripheral edge portion located on a first side of the first arm axis and a second peripheral edge portion located on a second side of the first arm axis;

a second arm component extending along a second arm axis and comprising a second arm portion and a second cover portion, the second cover portion protruding from opposing lateral sides of the second arm portion and having a first peripheral edge portion located on a first side of the second arm axis and a second peripheral edge portion located on a second side of the second arm axis;

wherein the corner brackets are adjustable to alter an angle measured between the first and second arm axes between a minimum angle position wherein at least a portion of the first peripheral edge portion of the first cover portion contacts at least a portion of the second peripheral edge portion of the second cover portion and a maximum angle position wherein at least a portion of the second peripheral edge portion of the first cover portion contacts at least a portion of the first peripheral edge portion of the second cover portion wherein in the minimum angle position the first arm axis is oriented at an acute angle of approximately 30° relative to the second arm axis; and wherein the corner brackets are configured to be coupled to the rear surface of the ceiling panel so that for each of the corner brackets, the first arm portion at least partially nests within the channel of a first one of the suspension bars and the second arm portion at least partially nests within the channel of a second one of the suspension bars.

17. The panel assembly according to claim 16 wherein in the maximum angle position the first arm axis is oriented at a second angle of approximately 220° relative to the second arm axis, and wherein the contact between the first and second peripheral edge portions of the first and second arm components prevents the first and second arm axes from being oriented relative to one another at angles less than 30° and greater than 220°.

* * * * *